United States Patent [19]

Arakawa et al.

[11] Patent Number: 4,894,318

[45] Date of Patent: Jan. 16, 1990

[54] SILVER HALIDE COLOR PHOTOGRAPHIC MATERIAL COMPRISING A MAGENTA COUPLER AND A FORMALDEHYDE SCAVENGER AND METHOD OF PROCESSING THEREFOR

[75] Inventors: Jun Arakawa; Keiji Mihayashi, both of Kanagawa, Japan

[73] Assignee: Fuji Photo Film Co., Ltd., Kanagawa, Japan

[21] Appl. No.: 862,870

[22] Filed: May 13, 1986

[30] Foreign Application Priority Data

May 13, 1985 [JP] Japan ..... 60-101077
Dec. 13, 1985 [JP] Japan ..... 60-280374

[51] Int. Cl.[4] ..... G03C 7/40; G03C 7/32

[52] U.S. Cl. ..... 430/372; 430/505; 430/548; 430/581; 430/555

[58] Field of Search ..... 430/555, 372, 505, 548, 430/551

[56] References Cited

U.S. PATENT DOCUMENTS 3,148,062 9/1964 Whitmore et al. ..... 430/387
3,227,554 1/1966 Barr et al. ..... 430/382
4,336,324 6/1982 Koboshi ..... 430/421
4,435,503 3/1984 Mihayashi ..... 430/551
4,464,463 8/1984 Kojima ..... 430/551
4,552,834 11/1985 Lau et al. ..... 430/393
4,585,728 4/1986 Furutachi ..... 430/546

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide color photographic material comprising a support having thereon at least one silver halide emulsion layer, wherein the silver halide color photographic material contains an uncolored magenta coupler and at least one compound capable of reacting with and fixing formaldehyde vapor, and at least 30 mol % based on the total amount of the uncolored magenta coupler present in the silver halide color photographic material is an uncolored 5-pyrazolone 2-equivalent magenta coupler.

The silver halide color photographic material has good latent image stability and a reduced layer thickness and thus improved sharpness. It is further possible thereby to avoid a decrease in color density and the formation of fog normally present when the silver halide color photographic material is brought into contact with formaldehyde vapor during storage prior to color development processing.

50 Claims, No Drawings

SILVER HALIDE COLOR PHOTOGRAPHIC MATERIAL COMPRISING A MAGENTA COUPLER AND A FORMALDEHYDE SCAVENGER AND METHOD OF PROCESSING THEREFOR

FIELD OF THE INVENTION

The present invention relates to a silver halide color photographic material containing an uncolored dye-forming coupler capable of coupling with an oxidation product of an aromatic primary amine developing agent to form a magenta dye (hereinafter referred to as an uncolored magenta coupler). More particularly the present invention relates to a silver halide color photographic material containing an uncolored magenta coupler, which can sustain original desirable photographic properties even when it is brought into contact with formaldehyde vapor during storage. The invention further relates to a method for processing such a light-sensitive material which requires an extremely short development time, which produces excellent desilvering effects, or which uses a much reduced amount of washing water to thereby reduce energy costs and environmental pollution problems, while minimizing variations in the minimum color density.

BACKGROUND OF THE INVENTION

Recently, furniture and construction materials processed with formalin (usually used to refer to a 37 wt % formaldehyde solution), adhesives containing formaldehyde as a hardening agent, goods made of formaldehyde resins, leather goods tanned with formalin, clothes treated with formalin as a sterilizer or a bleaching agent, and the like are frequently utilized in daily life. Therefore, there are many opportunities for conventional photographic light-sensitive materials to be brought into contact with formaldehyde vapor released from these daily necessities.

In general, a silver halide color photographic material is composed of a support having coated thereon some silver halide emulsion layers each of which has sensitivity in a different region of the spectrum and which contains a coupler capable of reacting with an oxidation product of a color developing agent to form a dye. For example, the photographic material may contain silver halide emulsion layers on a support each of which is sensitive to blue light, green light, and red light and contains a yellow coupler, a magenta coupler, and a cyan coupler, respectively, in a conventional case. After exposure to light, the photographic material is subjected to color development processing to form yellow, magenta, and cyan color dye images in these silver halide emulsion layers, respectively. In such a multilayer color photographic material, it is desired that each silver halide emulsion layer be well balanced with respect to sensitivity and gradation, in order to obtain an excellent color image. It is also desired that the photographic properties of the photographic material are not changed during storage for a long period of time either before or after exposure to light until it is subjected to color development processing.

However, when a conventional silver halide color photographic material is brought into contact with formaldehyde vapor before color development processing, not only is the coupler incorporated therein consumed by the reaction with formaldehyde but an undesirable by-product is also formed. As a result, degradation of the photographic properties, for example, decrease in color density, increase in color stain and fog, etc., occurs. The degradation of photographic properties due to formaldehyde vapor is serious in the case of the so-called 4-equivalent couplers having an active methylene group. Particularly, magenta couplers tend to be adversely affected by formaldehyde.

It has hitherto been proposed that a compound which reacts with formaldehyde be incorporated into a silver halide color photographic material containing a coupler for the purpose of preventing the degradation of photographic properties due to formaldehyde vapor. However, known compounds for preventing the degradation of photographic properties due to formaldehyde vapor (hereinafter referred to as formaldehyde scavengers) in conventional silver halide color photographic materials containing an oil-soluble 4-equivalent magenta coupler, as described in Japanese Patent Publication Nos. 38418/73 and 23908/76, U.S. Pat. Nos. 3,652,278, 3,770,431, 4,414,309, 4,411,987, 4,490,460 and 4,435,503, *Research Disclosure*, Vol. 101, RD No. 10133 (August 1972), etc., only have a slight ability with respect to fixing formaldehyde vapor. Therefore, sufficient effects cannot be obtained. Further, when they are used in a large amount, a disadvantage is encountered, in that the film properties of the photographic light-sensitive material are degraded.

Moreover, the degradation of photographic properties due to formaldehyde vapor is seriously observed with magenta color images, in particular, in case of using conventional 4-equivalent magenta couplers. In order to overcome this problem, another method using 5-pyrazolone 2-equivalent magenta couplers as described in Japanese Patent Application (OPI) Nos. 62454/80, 38043/81, 4044/82, 17440/83, 50537/83, 85432/83, 117546/83, 126530/83, 170/79, 10491/79, 21258/79, 46453/78, 2953/85, 23855/85, and 170854/85 (the term "OPI" as used herein refers to a "published unexamined Japanese patent application"), U.S. Pat. Nos. 3,257,554, 3,432,521, 3,935,015, 4,126,462, 4,189,321, 4,241,168, 4,264,723, 4,301,235, 4,308,343, 4,310,618, 4,310,619, 4,334,011, 4,351,897, 4,367,282, 4,407,936, 4,436,808 and 4,522,915, etc.

When such 2-equivalent magenta couplers are employed in place of conventional 4-equivalent magenta couplers, such is observed to provide improved effects on the decrease in color density occurred when the photographic materials are brought into contact with formaldehyde vapor during storage. In contrast with this, however, the increases in fog is markedly promoted.

Further, it is found that such increases in fog occurs not only with respect to the magenta color, but also occurs with respect to the cyan and yellow couplers. This is a serious defect in the photographic properties. The reason for the increase in fog is not completely clear, but it may occur as follows. That is, 4-equivalent magenta couplers conventionally used react with formaldehyde vapor to decrease the concentration of formaldehyde vapor in the coated layer when they are brought into contact with formaldehyde vapor during storage. As a result, they act to decrease the reducing function of formaldehyde on a silver halide emulsion in compensation for the degradation of their color forming property. On the contrary, in case of using 2-equivalent magenta couplers which do not substantially react with formaldehyde, their color forming property does not decrease, but the reducing function of formaldehyde to the silver halide emulsion increases by means of a rise in the concentration of formaldehyde in the coated layer. However, such a mechanism is still uncertain, and requires further investigations in the future.

On the other hand, 2-equivalent magenta couplers having a pyrazoloazole skeleton as described in Japanese Patent Publication No. 30895/73, Japanese Patent Application (OPI) Nos. 17196/84 and 99437/84, U.S. Pat. Nos. 3,725,067 and 4,500,630, etc., are also known as a different type of 2-equivalent magenta couplers from the 5-pyrazolone type. It is known that these couplers undergo a small change in their color forming property when they are brought into contact with formaldehyde vapor in comparison with the case wherein they do not. However, these pyrazoloazole type couplers have serious problems per se in that degradation of photographic properties, for example, decrease in sensitivity and deterioration of color forming property is severe during storage under conditions free from formaldehyde vapor. In particular, a phenomenon in which a latent image formed in silver halide upon exposure to light is gradually destroyed and disappears during a period of storage prior to development, that is, a so-called latent image fading, occurs to a significant extent with these 2-equivalent magenta couplers having a pyrazoloazole skeleton. Further, a severe problem is that such latent image fading greatly accelerates when these pyrazoloazole type magenta couplers are employed together with formaldehyde scavengers for the purpose of restraining fog due to formaldehyde vapor.

On the other hand, in view of the recent trends, such as water shortages, steep rises in sewarage rates and fuel expenses, increased environmental concerns, and the like, it has been demanded to develop a method of processing using a reduced amount of washing water. As a countermeasure for these problems, methods in which a washing step is omitted or the amount of washing water is extremely decreased have been proposed. For example, U.S. Pat. No. 4,336,324 discloses inclusion of multiple countercurrent stabilization processing; Japanese Patent Application (OPI) No. 134636/83 discloses use of a stabilizer containing a bismuth salt; and Japanese Patent Application (OPI) No. 18631/83 teaches use of an organic phosphonic acid. However, any of these proposed methods involves problems, such as liability to variations in minimum density, or formation of stains after processing.

It has recently been demanded in the market to deliver developed prints to customers as soon as possible, and, therefore, there is increasing necessity for shortening development processing steps. In color photographic materials, especially color negative films, using silver iodobromide type emulsions, a desilvering step occupies a considerable proportion of the total time required for development processing, and it has thus been desired to shorten the desilvering step.

SUMMARY OF THE INVENTION

Therefore, one object of the present invention is to provide an extraordinarily superior silver halide color photographic material in which changes in the photographic properties such as decrease in color density and increase in fog, etc., are small when the photographic light-sensitive material is subjected to contact with formaldehyde vapor during storage prior to color development processing.

Another object of the present invention is to provide a silver halide color photographic material having a reduced emulsion layer thickness and improved sharpness.

A further object of the present invention is to provide a silver halide color photographic material having a good latent image durability.

A fourth object of this invention is to provide a method for processing a light-sensitive material which requires a greatly reduced amount of washing water, to thus reduce environmental pollution and save energy and resources.

A fifth object of this invention is to provide a method for processing a light-sensitive material which shortens the time of development processing steps.

A sixth object of this invention is to provide a method for processing a light-sensitive material which causes less variation in the minimum color density.

A seventh object of this invention is to provide a method for processing a silver halide color photographic material which produces excellent desilvering effects.

Other objects of the present invention will be apparent from the following detailed description and examples.

These objects of the present invention are accomplished by a silver halide color photographic material comprising a support having thereon at least one silver halide emulsion layer, wherein the silver halide color photographic material contains an uncolored magenta coupler and at least one compound capable of reacting with and fixing formaldehyde vapor, and at least 30 mol % based on the total amount of the uncolored magenta coupler present in the silver halide color photographic material is an uncolored 5-pyrazolone 2-equivalent magenta coupler.

The term "uncolored 5-pyrazolone two-equivalent magenta coupler" as used herein refers to couplers other than so-called "colored couplers" employed in the art for the purpose of color correction and the like, and the term "uncolored" means that the coupler concerned is substantially colorless but not always completely colorless.

In another aspect, the present invention is directed to a method for processing a silver halide color photographic material described above, which comprises treating the material with a color developing solution containing a color development agent represented by the formula

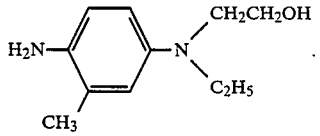

In a further aspect, the present invention is directed to method for processing a silver halide color photographic material as described above, wherein the material is washed with water or treated with stabilizing solution immediately after fixing or bleach-fix, further wherein said washing or stabilization is carried out in a multiple countercurrent system using a plurality of tanks in which a processing solution is replenished in an amount of from 3 to 50 times the amount of the processing solution carried over from the preceding bath per unit area of the photographic material. This method may be combined with the first method described above.

In yet another aspect, the present invention is directed to a method for processing a silver halide color photographic material as described above, which comprises conducting development processing in the presence of at least one compound represented by formula (III) or formula (IV)

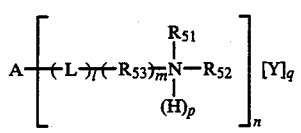

(III)

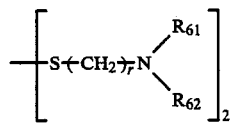

(IV)

In formula (III) above, A represents an n-valent aliphatic, aromatic or heterocyclic linking group (when n is 1, A simply represents an aliphatic, aromatic or heterocyclic group or a hydrogen atom); L represents —O—, —S— or

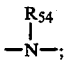

$R_{51}$ and $R_{52}$ each represents a substituted or unsubstituted lower alkyl group; $R_{53}$ represents a substituted or unsubstituted lower alkylene group; $R_{54}$ represents a substituted or unsubstituted lower alkyl group; or $R_{51}$ and $R_{52}$, $R_{51}$ and A, $R_{51}$ and $R_{53}$, $R_{52}$ and A, or $R_{52}$ and $R_{53}$ together form a ring; Y represents an anion; l represents 0 or 1; m represents 0 or 1; n represents 1, 2, or 3; p represents 0 or 1; and q represents 0, 1, 2 or 3.

In formula (IV) above, $R_{61}$ and $R_{62}$ each represents a hydrogen atom, a lower alkyl group or an acyl group, provided that they do not simultaneously represent a hydrogen atom; or $R_{61}$ and $R_{62}$ together form a ring; and r represents 1, 2, or 3.

This third method may be combined with the first method described above and/or the second method described above.

DETAILED DESCRIPTION OF THE INVENTION

The compound capable of reacting with and fixing formaldehyde vapor (also referred to as a formaldehyde scavenger) used in the present invention is represented by formula (I) or (II).

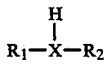

(I)

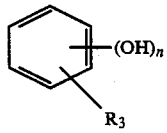

(II)

In the above formulae, $R_1$ and $R_2$, which may be the same or different, each has up to 20 carbon atoms and represents a hydrogen atom, an alkyl group (e.g., a methyl group, an ethyl group, an n-propyl group, etc.), a substituted alkyl group, an aralkyl group (e.g., a benzyl group, etc.), a substituted aralkyl group, an aryl group (e.g., a phenyl group, a naphthyl group, etc.), a substituted aryl group, an acyl group (e.g., an acetyl group, a malonyl group, a benzoyl group, a cinnamoyl group, etc.), an alkoxycarbonyl group (e.g., a methoxycarbonyl group, an ethoxycarbonyl group, etc.), a carbamoyl group (for example, a carbamoyl group, an alkylcarbamoyl group (e.g., a methylcarbamoyl group, an ethylcarbamoyl group, etc.), a dialkylcarbamoyl group (e.g., a dimethylcarbamoyl group, etc.), an arylcarbamoyl group (e.g., a phenylcarbamoyl group, etc.)), an amino group (for example, an amino group, an alkylamino group (e.g., a methylamino group, an ethylamino group, etc.), an arylamino group (e.g., a phenylamino group, a naphthylamino group, etc.)), or a halogen atom (e.g., a chlorine atom, a bromine atom, etc.), or $R_1$ and $R_2$ may be bonded to each other to form a ring and at least one of $R_1$ and $R_2$ is an acyl group, an alkoxycarbonyl group, a carbamoyl group or an amino group; and X represents

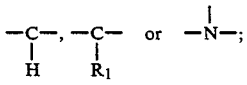

$R_3$ has up to 32 carbon atoms and represents an alkyl group (e.g., a methyl group, an ethyl group, an n-propyl group, etc.), a substituted alkyl group, an aralkyl group (e.g., a benzyl group, etc.), a substituted aralkyl group, an aryl group (e.g., a phenyl group, a naphthyl group, etc.) or a substituted aryl group, these aryl group and substituted aryl group may form a condensed ring together with a 5-membered, 6-membered or 7-membered ring, and n represents an integer of not less than 2, and has of an equivalent molecular weight of not more than 300 per unit of an active hydrogen atom as defined by the equation below.

$$\text{Equivalent Molecular Weight} = \frac{\text{Molecular Weight}}{\text{Number of Active Hydrogen Atoms in Molecule}}$$

The substituents for the substituted alkyl group, the substituted aralkyl group or the substituted aryl group defined above include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carboxy group, a carbamoyl group (e.g., a methylcarbamoyl group, etc.), an alkoxycarbonyl group (e.g., a methoxycarbonyl group), a sulfonyl group (e.g., a methylsulfonyl group, etc.), and when there are two or more substituents, they may be the same or different.

The compounds represented by formula (I) are more preferred than the compounds represented by formula (II).

Of the formaldehyde scavengers represented by formulae (I) and (II), preferred compounds are those represented by formulae (I-1) to (I-8) and (II-1) to (II-2), including keto-enol tautomers thereof.

[I-1]

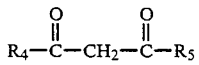

[I-2]

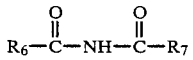

[I-3]

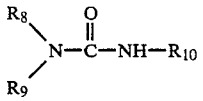

[I-4]

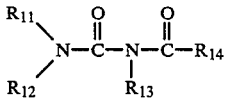

[I-5]

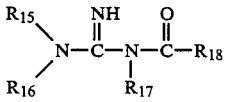

[I-6]

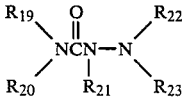

[I-7]

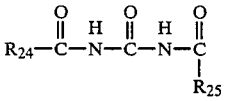

[I-8]

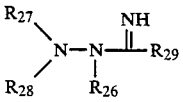

[II-1]

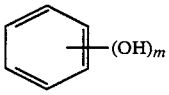

[II-2]

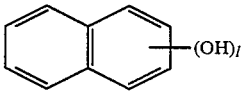

In the above formulae, $R_4$ to $R_{25}$ and $R_{27}$ to $R_{29}$, each has up to 20 carbon atoms and represents a hydrogen atom, a halogen atom (e.g., a chlorine atom, etc.) and alkyl group (e.g., a methyl group, an ethyl group, an n-propyl group, etc.), a substituted alkyl group, an aralkyl group (e.g., a benzyl group, etc.), a substituted aralkyl group, an aryl group (e.g., a phenyl group, a naphthyl group, etc.), or a substituted aryl group. One of $R_{11}$, $R_{12}$, $R_{13}$, and $R_{14}$ and one of $R_{19}$, $R_{20}$, $R_{21}$, $R_{22}$ and $R_{23}$ each represents a hydrogen atom.

$R_{26}$ represents a halogen atom (e.g., a chlorine atom, a bromine atom, etc.), an alkyl group (e.g., a methyl group, an ethyl group, an n-propyl group, etc.), a substituted alkyl group, an aralkyl group (e.g., a benzyl group, a phenethyl group, etc.), a substituted aralkyl group, an aryl group (e.g., a phenyl group, a naphthyl group, etc.), a substituted aryl group, a heterocyclic group (e.g., a 2-pyridyl group, a 4-pyridyl group, etc.), a carbonyl group (e.g., a methylcarbonyl group, a phenylcarbonyl group, etc.), a sulfonyl group (e.g., a methyl sulfonyl group, a phenylsulfonyl group, etc.), a carboxy group,

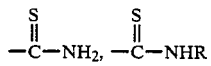

(wherein R represents an aryl group) or

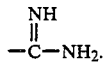

Substituents for the substituted alkyl group, the substituted aralkyl group or the substituted aryl group defined above include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carboxyl group, a ureido group (e.g., a ureido group, a 3-methylureido group, etc.), a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), and when there are two or more substituents, they may be the same or different.

$R_4$ and $R_5$, $R_6$ and $R_7$, and $R_{24}$ and $R_{25}$ may be bonded each other to form a ring. Any two substituents selected from $R_8$ to $R_{10}$, $R_{11}$ to $R_{14}$, $R_{15}$ to $R_{18}$, $R_{19}$ to $R_{23}$, and $R_{26}$ to $R_{29}$ may be bonded each other to form a ring. m represents an integer of from 3 to 6 and l represents an integer of 2 to 8.

Of the formaldehyde scavengers represented by the general formulae (I-1) to (I-8) and (II-1) to (II-2), more preferred compounds are those represented by the formulae (I-3) to (I-8).

Of these, compounds represented by formula (I-3a) or (3-b) is preferred.

(I-3a)

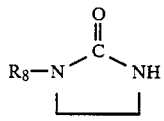

(I-3b)

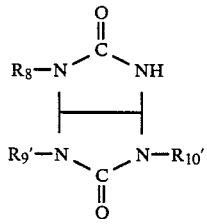

In the above formulae, $R_8$ has the same meaning as defined hereinbefore, and $R_9'$ and $R_{10}'$ have the same meanings as defined above for $R_9$ and $R_{10}$, respectively.

In the present invention, use of the compound represented by formula (I-3a) and the compound represented by formula (I-3b) in combination gives rise to more preferred results.

Specific examples of the formaldehyde scavengers used in the present invention are set forth below, but the compounds used in the present invention are not to be construed as being limited thereto.

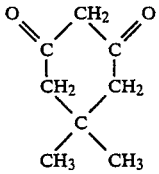
(S-1)
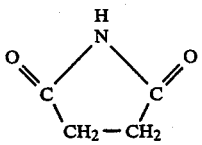
(S-2)
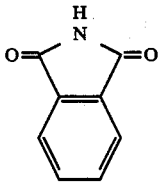
(S-3)
$NH_2CONHCH_2CH_2NHCONH_2$ (S-4)
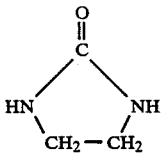
(S-5)
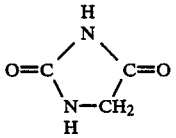
(S-6)
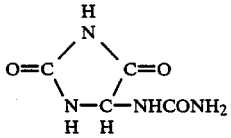
(S-7)
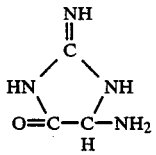
(S-8)
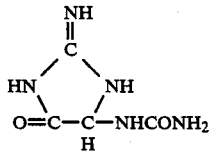
(S-9)
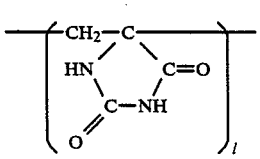
(S-10)
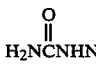
(S-11)
-continued
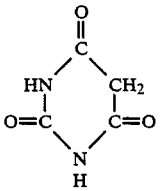
(S-12)
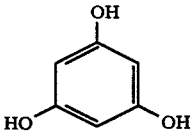
(S-13)
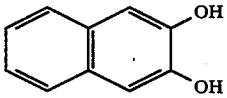
(S-14)
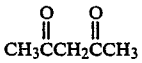
(S-15)
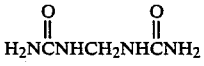
(S-16)
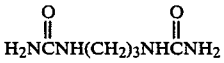
(S-17)
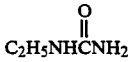
(S-18)
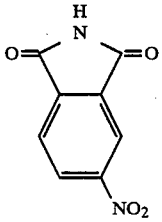
(S-19)
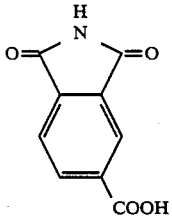
(S-20)
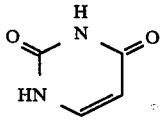
(S-21)
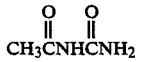
(S-22)
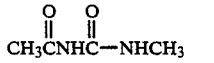
(S-23)
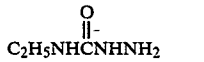
(S-24)
$CH_3CONHCONHCOCH_3$ (S-25)

-continued (S-26)

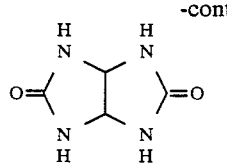

(S-27)

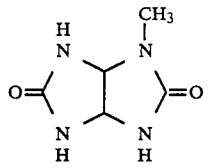

(S-28)

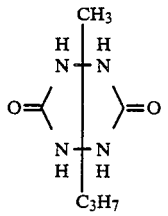

(S-29)

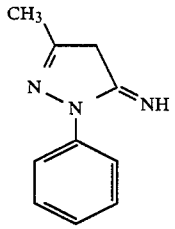

(S-30)

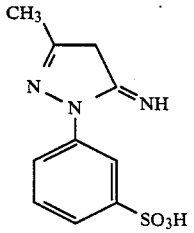

(S-31)

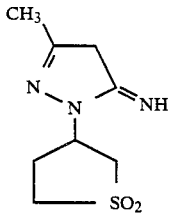

The above described Compound (S-10) is an oligomer or a polymer having the above described repeating units, the number of which is represented by l.

Formaldehyde scavengers (S-1) to (S-6) and (S-12) to (S-23) are typically commercially available compounds. Formaldehyde scavengers (S-7) to (S-11) can be easily synthesized according to the method as described in *Bulletin of the Chemical Society of Japan*, Vol. 39, pages 1559 to 1567 and 1734 to 1738 (1966), *Chemische Berichte*, Vol. 54B, pages 1802 to 1833 and 2441 to 2479 (1921), *Beilstein Handbuch der Organischen Chemie*, H, page 98 (1921), etc. Formaldehyde scavengers (S-24) and (S-25) can be synthesized by the methods as described in *Beilstein Handbuch der Organischen Chemie*, First Supplemental Edition, Vol. 4, page 354, and Vol. 3, page 63, etc. Formaldehyde scavengers (S-26) to (S-28) can be easily synthesized from known compounds according to the method as described in U.S. Pat. No. 4,411,987, etc. Formaldehyde scavengers (S-29) to (S-31) can be easily synthesized from known compounds according to the method as described, e.g., in U.S. Pat. No. 4,414,309 and R. H. Wiley and P. Wiley, *The Chemistry of Heterocyclic Compounds*, Pyrazolones, pyrazolidones and Derivatives (Interscience Publishers, 1964), etc.

The formaldehyde scavenger employed in the present invention may be used as a mixture of two or more thereof.

The formaldehyde scavenger used in the present invention can be incorporated into at least one layer of a silver halide color photographic material, such as a silver halide emulsion layer, a subbing layer, a protective layer, an intermediate layer, a filter layer, an antihalation layer and other auxiliary layers. The objects of the present invention can be attained by adding the formaldehyde scavenger to any of a silver halide emulsion layer containing an uncolored magenta coupler, the photographic properties of which are degraded in contact with formaldehyde vapor, a layer which is positioned closer to the support than said silver halide emulsion layer and a layer which is positioned further away from the support than said silver halide emulsion layer. The formaldehyde scavenger preferably is incorporated into a layer which is positioned further away from the support than a silver halide emulsion layer containing an uncolored 5-pyrazolone 2-equivalent magenta coupler and more preferably into a protective layer.

In order to incorporate the formaldehyde scavenger used in the present invention into the photographic layer, the compound can be added to a coating solution for the layer directly or by dissolving it in a solvent which does not impart adverse effects to the silver halide color photographic material, for example, water, an alcohol, etc., in an appropriate concentration. Also, the formaldehyde scavenger can be added by dissolving the compound in an organic solvent having a high boiling point and/or an organic solvent having a low boiling point and dispersing the solution into an aqueous solution. The formaldehyde scavenger can be added at any period of time during the production of the color photographic light-sensitive material. However, it is generally desirable that the compound is added just before coating. Generally, the formaldehyde scavenger is added in an amount of from 0.005 g to 5 g, preferably from 0.01 to 1 g, and more preferably from 0.05 to 0.5 g, per square meter of the silver halide color photographic material.

The uncolored 5-pyrazolone 2-equivalent magenta coupler which can be employed in the present invention is represented by formula (A)

(A)

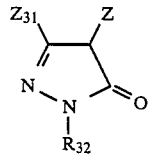

wherein $R_{31}$ represents a carbonamido group, an anilino group, a sulfonamido group or a ureido group; $R_{32}$ represents a phenyl group; and Z represents a group capable of being released as an anion upon the coupling reaction with an oxidation product of an aromatic primary amine developing agent (hereinafter referred to as a coupling-off group).

The coupling-off group represented by Z has 1 to 32 carbon atoms and includes a group connecting an aliphatic group, an aromatic group, a heterocyclic group, an aliphatic, aromatic or heterocyclic sulfonyl group, an aliphatic, aromatic or heterocyclic carbonyl group, a carbamoyl group, an alkoxycarbonyl group or an aryloxycarbonyl group with the coupling active carbon atom through an oxygen atom, a nitrogen atom, a sulfur atom or a carbon atom, a halogen atom, an aromatic azo group, and a heterocyclic group, etc. The aliphatic group, aromatic group, or heterocyclic group included in the coupling-off group represented by Z and the groups represented by $R_{31}$ and $R_{32}$ may be substituted with one or more substituents.

Examples of the substituents include a halogen atom (for example, a fluorine atom, a chlorine atom, a bromine atom, etc.), an alkyl group (for example, a methyl group, a tert-octyl group, a dodecyl group, a trifluoromethyl group, etc.), an alkenyl group (for example, an allyl group, an octadecenyl group, etc.), an aryl group (for example, a phenyl group, a p-tolyl group, a naphthyl group, etc.), an alkoxy group (for example, a methoxy group, a benzyloxy group, a methoxyethoxy group, etc.), an aryloxy group (for example, a phenoxy group, a 2,4-di-tert-amylphenoxy group, a 3-tert-butyl-4-hydroxyphenoxy group, etc.), an acyl group (for example, an acetyl group, a benzoyl group, etc.), a sulfonyl group (for example, a methanesulfonyl group, a toluenesulfonyl group, etc.), a carboxyl group, a sulfo group, a cyano group, a hydroxyl group, an amino group (for example, an amino group, a dimethylamino group, etc.), a carbonamido group (for example, an acetamido group, a trifluoroacetamido group, a tetradecanamido group, a benzamido group, etc.), a sulfonamido group (for example, a methanesulfonamido group, a hexadecanesulfonamido group, a p-toluenesulfonamido group, etc.), an acyloxy group (for example, an acetoxy group, etc.), a sulfonyloxy group (for example, a methanesulfonyloxy group, etc.), an alkoxycarbonyl group (for example, a dodecyloxycarbonyl group, etc.), an aryloxycarbonyl group (for example, a phenoxycarbonyl group, etc.), a carbamoyl group (for example, a dimethylcarbamoyl group, a tetradecylcarbamoyl group, etc.), a sulfamoyl group (for example, a methylsulfamoyl group, a hexadecylsulfamoyl group, etc.), an imido group (for example, a succinimido group, a phthalimido group, an octadecenylsuccinimido group, etc.), a heterocyclic group (for example, a 2-pyridyl group, a 2-furyl group, a 2-thienyl group, etc.), an alkylthio group (for example, a methylthio group, etc.), an arylthio group (for example, a phenylthio group, etc.), or the like.

Specific examples of the coupling-off groups represented by Z include a halogen atom (for example, a fluorine atom, a chlorine atom, a bromine atom, etc.), an alkoxy group (for example, a benzyloxy group, etc.), an aryloxy group (for example, a 4-chlorophenoxy group, a 4-methoxyphenoxy group, etc.), an acyloxy group (for example, an acetoxy group, a tetradecanoyloxy group, a benzoyloxy group, etc.), an aliphatic or aromatic sulfonyloxy group (for example, a methanesulfonyloxy group, a toluenesulfonyloxy group, etc.), a carbonamido group (for example, a dichloroacetamido group, a trifluoroacetamido group, etc.), an aliphatic or aromatic sulfonamido group (for example, a methanesulfonamido group, a p-toluenesulfonamido group, etc.), an alkoxycarbonyloxy group (for example, an ethoxycarbonyloxy group, a benzyloxycarbonyloxy group, etc.), an aryloxycarbonyloxy group (for example, a phenoxycarbonyloxy group, etc.), an aliphatic aromatic or heterocyclic thio group (for example, an ethylthio group, a hexadecylthio group, a 4-dodecylphenylthio group, a pyridylthio group, etc.), a ureido group (for example, a methylureido group, a phenylureido group, etc.), a 5-membered or 6-membered nitrogen-containing heterocyclic group (for example, an imidazolyl group, a pyrazolyl group, a triazolyl group, a tetrazolyl group, a 1,2-dihydro-2-oxo-1-pyridyl group, etc.), an imido group (for example, a succinimido group, a phthalimido group, a hydantoinyl group, etc.) or the like.

Also, an example of a coupling-off group connecting through a carbon atom is a group of a so-called bis type coupler obtained by condensation of 4-equivalent couplers with an aldehyde or a ketone.

Of the uncolored 5-pyrazolone 2-equivalent magenta couplers represented by formula (A), those in which Z represents a 5- or 6-membered nitrogen atom-containing heterocyclic group wherein the nitrogen atom is attached to the 4-position of the 5-pyrazolone nucleus are preferred, and those in which Z represents a 1-pyrazolyl group are more preferred.

Further, any of $R_{31}$, $R_{32}$, and Z may be a divalent group or a polyvalent group, to form a polymer including a dimer or higher polymer. Moreover, the coupler skeletons may be connected to a main chain of a polymeric coupler.

Furthermore, $R_{31}$, $R_{32}$, or Z may form a polymer coupler including a bis type coupler or more. The polymer coupler may be a polymer of a monomer having an ethylenic unsaturated group in one of the groups represented by $R_{31}$, $R_{32}$ and Z or a copolymer of such a monomer and a non-color forming monomer.

When the coupler residue according to the present invention represents a polymer, it includes a polymer which is derived from a monomer coupler represented by formula ($C_p$-1) described below, and which contains a repeating unit represented by formula ($C_p$-2) described below, and a copolymer of the monomer coupler represented by formula ($C_p$-1) described below and at least one kind of a non-color forming monomer containing at least one ethylene group which does not have an ability of coupling with the oxidation product of an aromatic primary amine developing agent. In such cases, two or more kinds of the monomer couplers may be polymerized together.

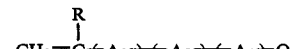

($C_p$-1)

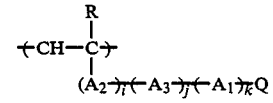

(C-2)

In formulae ($C_p$-1) and ($C_p$-2), R represents a hydrogen atom, a lower alkyl group containing from 1 to 4 carbon atoms or a chlorine atom; $A_1$ represents —CONR'—, —NR'CONR'—, —NR'COO—, —COO—, —$SO_2$—, —CO—, —NR'CO—, —$SO_2$NR'—, —NR'$SO_2$—, —OCO—, —OCONR'—, —NR'— or —O—; $A_2$ represents —CONR'— or —COO—; R' has up to 20 carbon atoms and represents a hydrogen atom, an aliphatic group or an aryl group, and when two or more R's are present in one molecule, they may be the same or different; $A_3$ represents an unsubstituted or substituted alkylene group having from 1 to 10 carbon atoms which may be a straight chain or a branched chain, an unsubstituted or substituted aralkylene group or an unsubstituted or substituted arylene group; Q represents a group derived from the magenta coupler represented by formula (A) which may be bonded at any portion of $R_{31}$, $R_{32}$, and Z; and i, j, and k each represents 0 or 1.

Examples of the alkylene group represented by $A_3$ include a methylene group, a methyl methylene group, a dimethylmethylene group, a dimethylene group, a trimethylene group, a tetramethylene group, a pentamethylene group, a hexamethylene group, a decylmethylene group, etc. Examples of the aralkylene group include a benzylidene group, etc. Examples of the arylene group include a phenylene group, a naphthylene group, etc.

The substituent for the alkylene group, aralkylene group or arylene group represented by $A_3$ includes an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxyl group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Examples of the non-color forming ethylenic monomer which does not couple with the oxidation product of an aromatic primary amine developing agent include an acrylic acid such as acrylic acid, α-chloroacrylic acid, and α-alkylacrylic acid such as methacrylic acid, etc., an ester or amide derived from an acrylic acid or an α-alkylacrylic acid such as methyl acrylate, ethyl acrylate, n-butyl acrylate, methyl methacrylate, N,N-dimethylacrylamide, etc., methylenebisacrylamide, a vinyl ester, an acrylonitrile, an aromatic vinyl compound such as styrene, α-methylstyrene, etc., a maleic acid derivative, a vinyl pyridine, etc. Two or more of the non-color forming ethylenically unsaturated monomers can be used together therewith.

Preferred are ternary copolymers of an uncolored 5-pyrazolone 2-equivalent magenta coupler monomer represented by formula (A) and two different non-color forming ethylenically unsaturated monomers one of which is an aromatic vinyl compound.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder in a photographic colloid composition, such as gelatin, flexibility, heat stability, etc.

The polymer couplers used in the present invention may be water-soluble coupler or water-insoluble couplers, but polymer coupler latexes are particularly preferred as such polymer couplers.

It is well known in the art that the coupler represented by formula (A) exhibits a keto-enol type tautomerism as illustrated below.

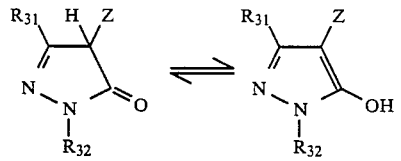

The effects according to the present invention are particularly remarkable when a polymer coupler having a repeating unit represented by formula (C-2) is used as the uncolored 5-pyrazolone 2-equivalent magenta coupler.

Specific examples of the magenta couplers represented by formula (A) and methods for synthesis thereof are described, for example, in Japanese Patent Application (OPI) Nos. 62454/80, 38043/81, 4044/82, 17440/83, 50537/83, 85432/83, 117546/83, 126530/83, 170/79, 10491/79, 21258/79, 46453/78, 2953/85, 23855/85, and 170854/85, U.S. Pat. Nos. 3,257,554, 3,432,521, 3,935,015, 4,126,462, 4,189,321, 4,241,168, 4,264,723, 4,301,235, 4,308,343, 4,310,618, 4,310,619, 4,334,011, 4,351,897, 4,367,282, 4,407,936, 4,436,808 and 4,522,915, etc.

Preferred examples of 5-pyrazolone 2-equivalent magenta couplers represented by the general formula (A) are set forth below, but the present invention should not be construed as being limited thereto.

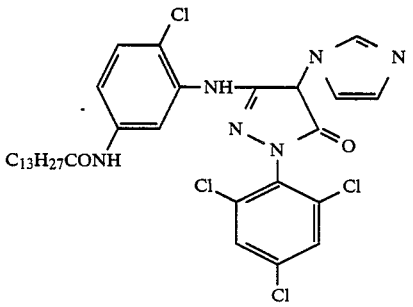

(M-1)

-continued
(M-2)
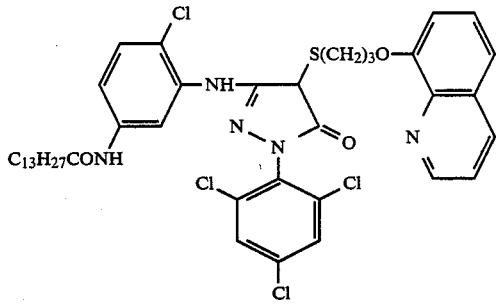
(M-3)
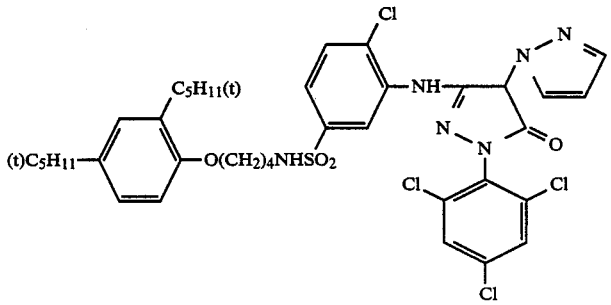
(M-4)
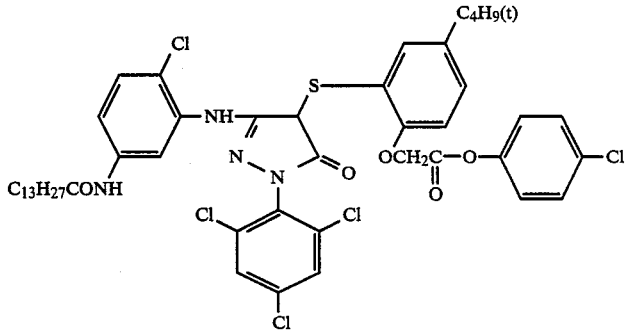
(M-5)
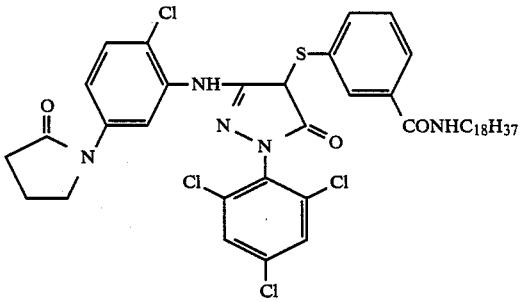
(M-6)
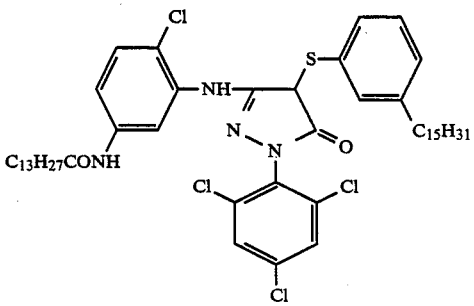

-continued
(M-7)
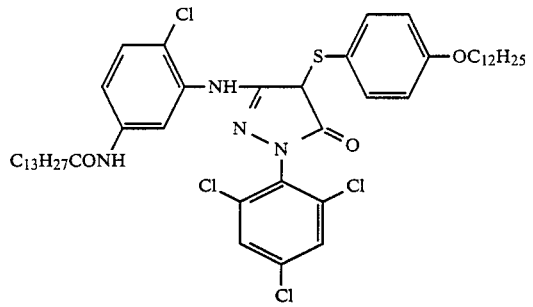
(M-8)
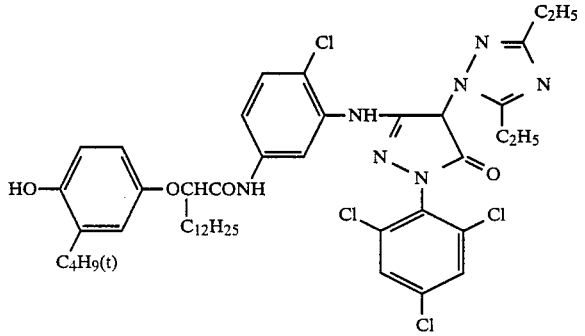
(M-9)
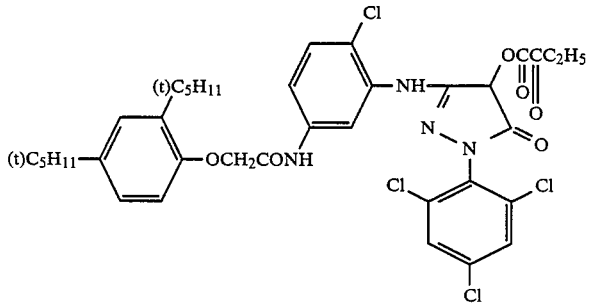
(M-10)
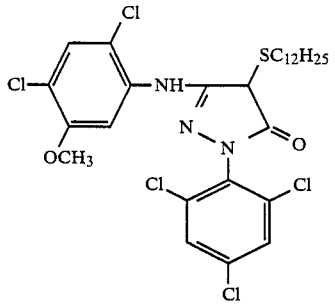
(M-11)
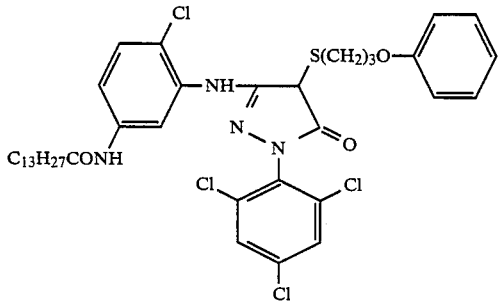

-continued
(M-12)
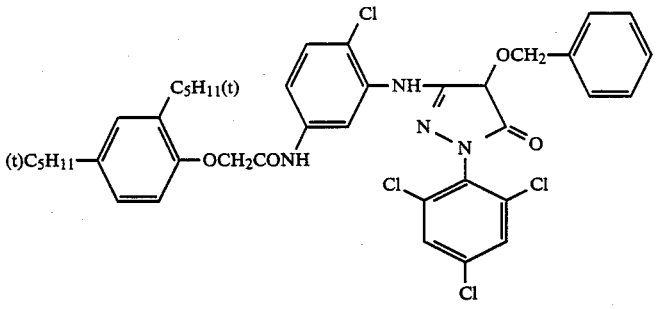
(M-13)
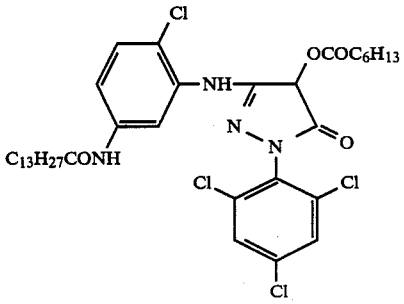
(M-14)
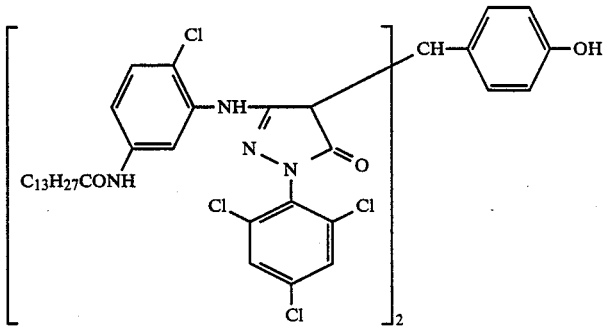
(M-15)
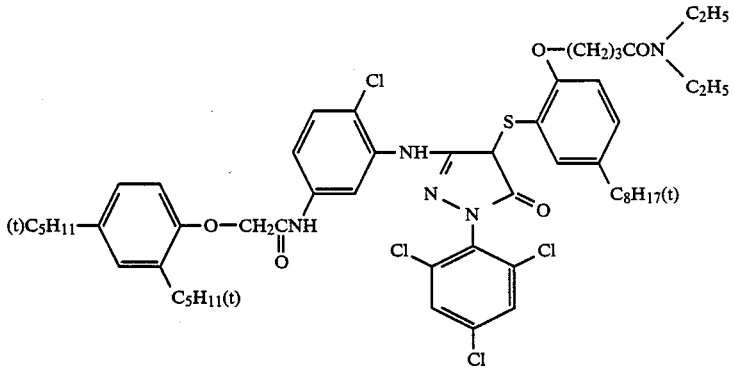
(M-16)
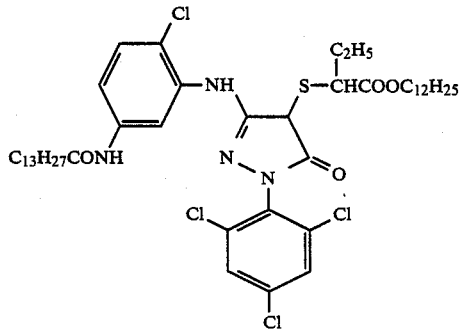

-continued

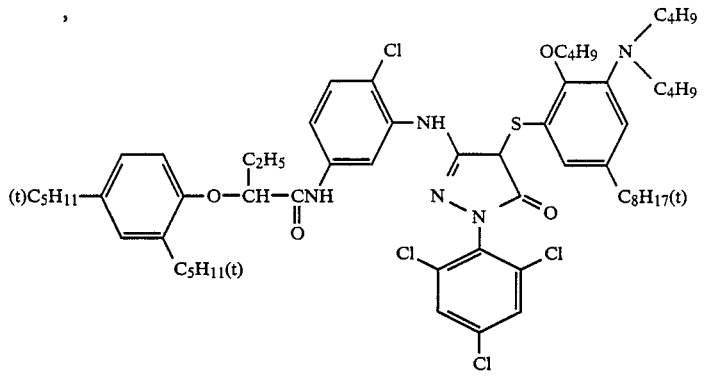

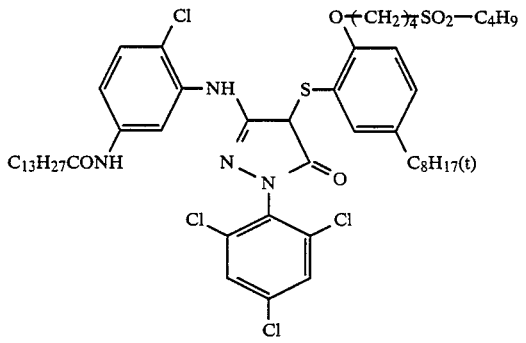

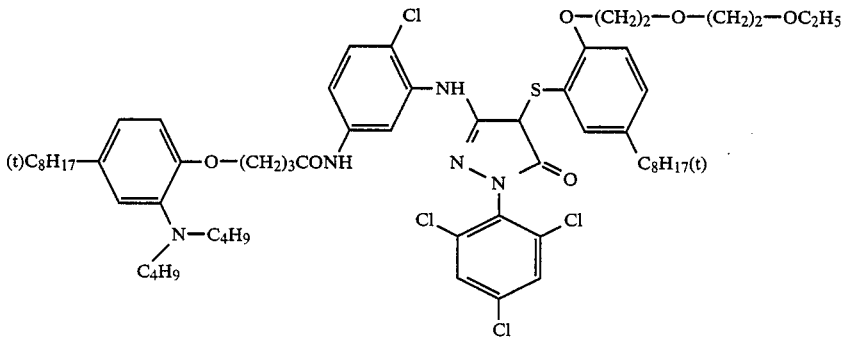

The uncolored 5-pyrazolone 2-equivalent magenta couplers according to the present invention can be employed individually or as a mixture of two or more thereof.

The amount of the uncolored 5-pyrazolone 2-equivalent magenta coupler added according to the present invention is 30 mol % or more, preferably 50 mol % or more, and more preferably 70 mol % or more based on the total amount of the uncolored magenta coupler present in the photographic light-sensitive material.

The compound represented by formula (III) which can be used in the present invention is described in more detail below.

In formula (III), A represents an n-valent aliphatic, aromatic, or heterocyclic linking group (when n is 1, A simply represents an aliphatic, aromatic or heterocyclic group or a hydrogen atom.

The aliphatic linking group as represented by A includes an alkylene group having from 3 to 12 carbon atoms, e.g., a trimethylene group, a hexamethylene group, a cyclohexylene group, etc. The aromatic linking group includes an arylene group having from 6 to 18 carbon atoms, e.g., a phenylene group, a naphthylene group, etc. The heterocyclic linking group includes a heterocyclic group having at least one hetero atom (e.g., an oxygen atom, a sulfur atom or a nitrogen atom), e.g., a thiophene, furan, triazine, pyridine, piperidine, etc.

These aliphatic linking groups, aromatic linking groups or heterocyclic linking groups are usually composed of one group, but may be composed of two or more linking groups connected either directly or via a divalent linking group (e.g., —O—, —S—,

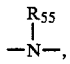

$—SO_2—$, —CO— or a combination thereof, wherein $R_{55}$ represents a lower alkyl group having 1 to 5 carbon atoms).

The above-described aliphatic, aromatic or heterocyclic linking groups may have a substituent, such as an alkoxy group, a halogen atom, an alkyl group, a hydroxyl group, a carboxyl group, a sulfo group, a sulfonamido group, a sulfamoyl group, etc.

L represents —O—, —S— or $$-\overset{\overset{\displaystyle R_{54}}{|}}{N}-,$$

wherein $R_{54}$ represents a lower alkyl group having 1 to 5 carbon atoms, e.g., a methyl group, an ethyl group, etc. $R_{51}$ and $R_{52}$ each represents a substituted or unsubstituted lower alkyl group having 1 to 5 carbon atoms, e.g., a methyl group, an ethyl group, a propyl group, an isopropyl group, a pentyl group, etc. The substituents, which may be the same or different in the case of plural groups, preferably include a hydroxyl group, a lower alkoxy group (e.g., a methoxy group, a methoxyethoxy group, a hydroxyethoxy group, etc.) and an amino group (e.g., an unsubstituted amino group, a dimethylamino group, an N-hydroxyethyl-N-methylamino group, etc.).

$R_{53}$ represents a lower alkylene group having from 1 to 5 carbon atoms, e.g., a methylene group, an ethylene group, a trimethylene group, a methylmethylene group, etc. Y represents an anion, such as a halide ion (e.g., a chlorine ion, a bromine ion, etc.), a nitrate ion, a sulfate ion, a p-toluenesulfonate ion, an oxalate ion, etc.

$R_{51}$ and $R_{52}$ may be taken together via a carbon atom or a hetero atom (e.g., an oxygen atom, a nitrogen atom or a sulfur atom) to form a 5- or 6-membered heterocyclic ring (e.g., a pyrrolidine ring, a piperidine ring, a morpholine ring, a triazine ring, an imidazolidine ring, etc.).

$R_{51}$ (or $R_{52}$) and A may be taken together via a carbon atom or a hetero atom (e.g., an oxygen atom, a nitrogen atom or a sulfur atom) to form a 5- or 6-membered heterocyclic ring (e.g., a hydroxyquinoline ring, a hydroxyindole ring, an isoindoline ring, etc.).

$R_{51}$ (or $R_{52}$) and $R_{53}$ may be taken together via a carbon atom or a hetero atom (e.g., an oxygen atom, a nitrogen atom or a sulfur atom) to form a 5- or 6-membered hetero ring (e.g., a piperidine ring, a pyrrolidine ring, a morpholine ring, etc.).

l represents 0 or 1; m represents 0 or 1; n represents 1, 2, or 3; p represents 0 or 1; and q represents 0, 1, 2, or 3.

Specific examples of the compound represented by the formula (III) are shown below, but they are not limiting the present invention:

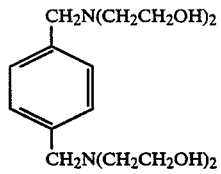

(1)

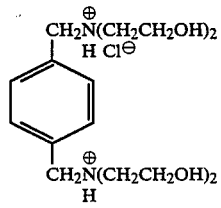

(2)

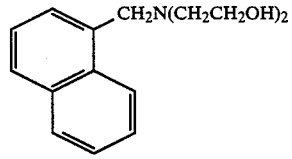

(3)

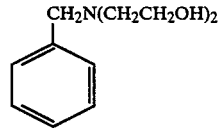

(4)

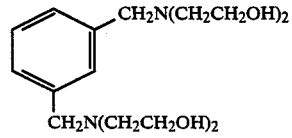

(5)

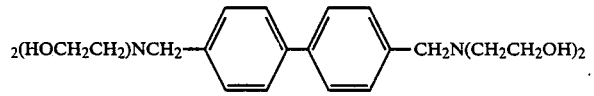

(6)

-continued
(7)
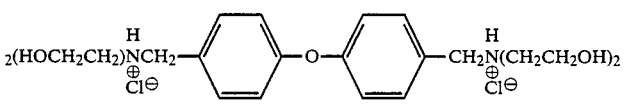
(8)
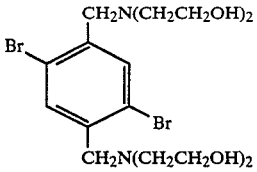
(9)
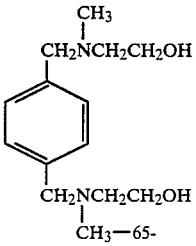
(10)
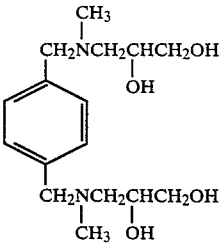
(11)
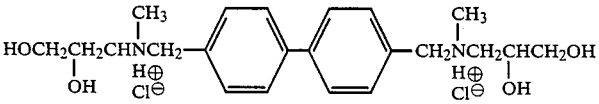
(12)
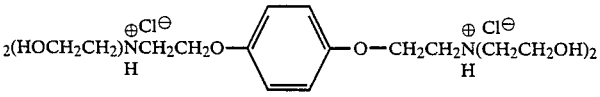
(13)
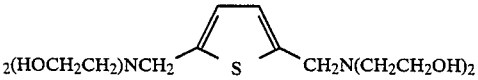
(14)
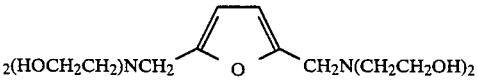
(15)
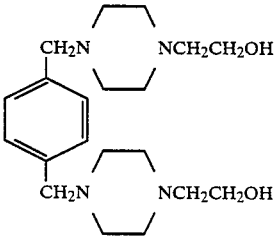

-continued (16)

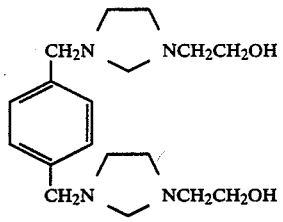

(17)

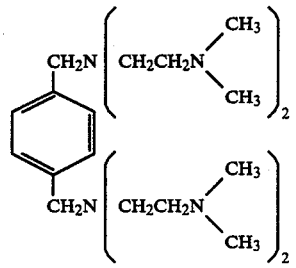

(18)

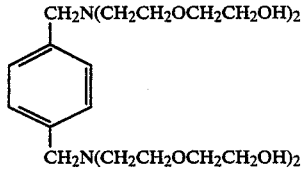

(19)

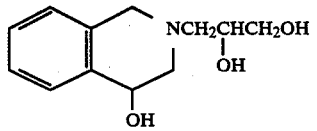

(20)

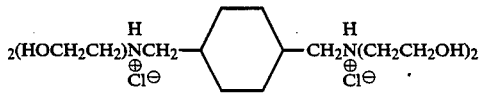

(21)

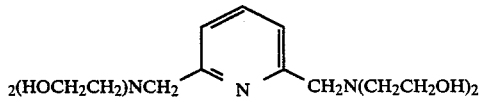

(22)

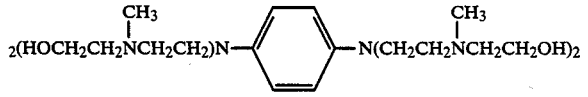

(23)

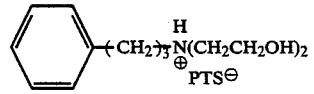

(24)

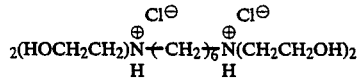

The compounds of the formula (III) can be synthesized easily by methods disclosed in well known publications, e.g., U.S. Pat. No. 4,552,834, Japanese Patent Application (OPI) No. 192953/82, Japanese Patent Publication No. 12056/79, etc.

The compounds represented by the formula (IV) which can be used in the present invention will be described below.

In the formula (IV), $R_{61}$ and $R_{62}$, which may be the same or different, each represents a hydrogen atom, a substituted or unsubstituted lower alkyl group (preferably the one having from 1 to 5 carbon atoms, and more preferably a methyl group, an ethyl group or a propyl group) or an acyl group (preferably having from 1 to 3 carbon atoms, e.g., an acetyl group, a propionyl group, etc.).

r represents an integer of from 1 to 3.

$R_{61}$ and $R_{62}$ together can form a ring, preferably a 5-, 6- or 7-membered nitrogen atom-containing heterocyclic group (e.g., a 1-piperidino group, a 1-pyrrolidino group, a 1-morpholino group, etc.).

Preferred groups for $R_{61}$ or $R_{62}$ are substituted or unsubstituted lower alkyl groups.

The substituents possessed by $R_{61}$ or $R_{62}$ include a hydroxyl group, a carboxyl group, a sulfo group, an amino group, etc.

Specific but non-limiting examples of the compounds represented by formula (II) are shown below:

(N-1)

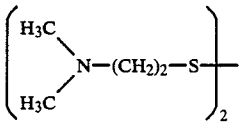

(N-2)

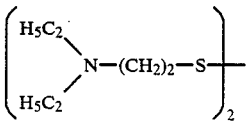

(N-3)

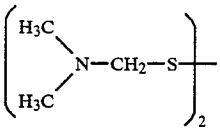

(N-4)

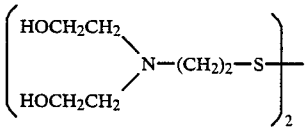

(N-5)

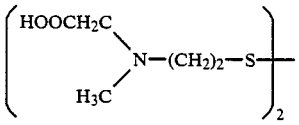

(N-6)

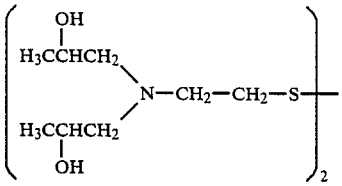

(N-7)

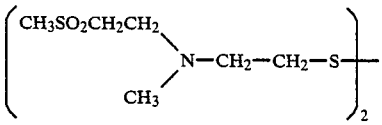

(N-8)

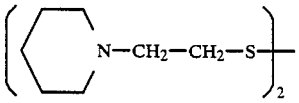

(N-9)

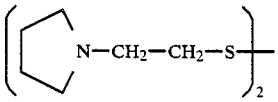

-continued (N-10)

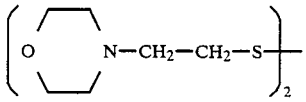

The compounds represented by the formula (IV) can be synthesized easily by the method disclosed in Japanese Patent Application (OPI) No. 95630/78.

In cases where the compound of formula (III) and/or the compound of the formula (IV) is/are incorporated into a light-sensitive material, they may be incorporated into any one or more of an antihalation layer, an intermediate layer between layers having different color sensitivities, between layers having the same color sensitivity, or between a light-sensitive layer and a light-sensitive layer, or a like intermediate layer, a light-sensitive silver halide emulsion layer, a light-sensitive silver halide emulsion layer, a yellow filter layer, a protective layer, and the like.

These compounds may be added either individually or in combinations of two or more thereof. The total amount of the compounds of formula (III) and/or the compounds of the formula (IV) to be added ranges from $1\times10^{-5}$ to $1\times10^{-2}$ mol/m$^2$, preferably from $2\times10^{-5}$ to $5\times10^{-3}$ mol/m$^2$, and more preferably from $5\times10^{-5}$ to $2\times10^{-3}$ mol/m$^2$.

In cases where the compounds of the formula (III) and/or the compound of the formula (IV) are used during the processing, they are added to any of a bleaching bath, a bleach-fix bath and a bath preceding a processing bath having a bleaching effect (e.g., a development bath, a prebath for a bleaching or bleach-fix bath, etc.), and preferably to a development bath, a bleaching bath or a bleach-fix bath.

The total amount of these compounds to be added to a processing bath varies depending on the type of photographic materials to be processed, the processing temperature, the time required for the intended processing, and the like but, in general, ranges from $2\times10^{-4}$ to $1\times10^{-1}$ mol/l, preferably from $5\times10^{-4}$ to $5\times10^{-2}$ mol/l, and more preferably from $2\times10^{-3}$ to $5\times10^{-2}$ mol/l.

When these compounds are incorporated into a light-sensitive material, they may be added to a coating composition as such or as a solution in a solvent that does not adversely affect silver halide color photographic materials, such as water, alcohols, etc., in appropriate concentrations. Incorporation may also be carried out by dissolving these compounds in a high-boiling organic solvent and/or a low-boiling organic solvent and emulsifying the organic solvent solution in an aqueous solution.

When these compounds are added to a processing solution, it is general to dissolve them in water, an alkali, an organic solvent, and the like in advance, but they may also be added thereto as being a powder.

It is already known to add the compound of the formula (II) to a bleaching bath or a bleach-fix bath, but incorporation into a light-sensitive material is rather preferred because such saves the necessity of alteration of a processing solution and also allows interchange with other processing steps.

When the silver halide color photographic material according to the present invention is processed in the presence of the compound of the formula (III) and/or the compound of the formula (IV), the increase in fog is smaller than in the case of applying other light-sensitive materials outside of the scope of this invention, and a rate of a desilvering attained is higher as compared with the case where each of the compound (III) and/or the compound (IV) are/is used alone, i.e., in the absence of a formaldehyde scavenger. The reasons accounting for these unexpected favorable results have not yet been elucidated, but results of various analyses led to the following belief.

Two-equivalent 5-pyrazolone magenta couplers are more liable to become an anion due to the extremely greater acid dissociation constant as compared with 4-equivalent 5-pyrazolone magenta couplers. If the compound of the formula (III) or (IV) having an amino group is present in such a situation, a proton emitted from the 2-equivalent coupler is added to the amino group to form an ammonium cation. It is believed that fog due to formaldehyde vapor is accelerated by the presence of this ammonium cation and that the formaldehyde scavenger exerts a surprising effect under such a condition.

Further, if the above-described formaldehyde scavenger is copresent together with both the compound of the formula (III) and the compound of the formula (IV), it is assumed that desorption of a sensitizing dye from a spectrally sensitized silver halide emulsion in the desilvering step can be accelerated.

The silver halide photographic light-sensitive material according to the present invention may be a monochromatic color photographic material having one light-sensitive silver halide emulsion layer on a support or a multilayer color photographic material containing layers sensitive to at least two different spectral wavelength ranges on a support. A multilayer color photographic material generally possesses at least one red-sensitive silver halide emulsion layer, at least one green-sensitive silver halide emulsion layer, and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and a yellow forming coupler is present in a blue-sensitive emulsion layer, respectively. However, if desired, a different combination can be employed.

The same or different photographic emulsion layers or light-insensitive layers of the photographic light-sensitive material according to the present invention can be incorporated, in addition to the couplers represented by formula (A) described above, with other color couplers, i.e., compounds capable of forming color upon oxidative coupling with aromatic primary amine developing agents (e.g., phenylenediamine derivatives, aminophenol derivatives, etc.) during the course of color development processing.

In a multilayer silver halide photographic material to which the present invention is applied, yellow, magenta, and cyan color forming couplers are usually employed.

Useful color couplers are cyan, magenta and yellow color forming couplers. Typical examples of useful color couplers include naphthol or phenol type compounds, pyrazolone or pyrazoloazole type compounds and open-chain or heterocyclic keto-methylene type compounds. Specific examples of utilizable cyan, magenta, and yellow couplers are described in the patents cited in *Research Disclosure*, RD No. 17643, VII-D (December 1978) and ibid., RD No. 18717 (November 1979).

It is preferable that these color couplers which are incorporated into photographic light-sensitive materials are diffusion resistant by means of containing a ballast group or polymerizing. 2-equivalent color couplers, the coupling active position of which is substituted with a group capable of being released, are preferably used, since the coating amount of silver can be reduced and high sensitivity is obtained compared with 4-equivalent color couplers, the coupling active position of which is substituted with a hydrogen atom. Further, couplers which forms dyes having an appropriate diffusibility, non-color forming couplers, or couplers capable of releasing development inhibitors (DIR couplers) or development accelerators accompanying with the coupling reaction can be employed.

As typical yellow couplers used in the present invention, oil protected acylacetamide type couplers are exemplified. Specific examples thereof are described in U.S. Pat. Nos. 2,407,210, 2,875,057 and 3,265,506, etc.

Typical examples of 2-equivalent yellow couplers include yellow couplers having an oxygen atom-containing coupling-off group wherein the oxygen atom is attached to the coupling position, as described in U.S. Pat. Nos. 3,408,194, 3,447,928, 3,933,501, 4,022,620, etc., and yellow couplers having a nitrogen atom-containing coupling-off group wherein the nitrogen atom is attached to the coupling position, as described in Japanese Patent Publication No. 10739/83, U.S. Pat. Nos. 4,401,752 and 4,326,024, *Research Disclosure*, RD No. 18053 (April 1979), British Pat. No. 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of the dyes formed, and α-benzoylacetanilide type couplers are characterized by their good color forming properties to provide a high color density.

As magenta couplers used together with the magenta couplers according to the present invention, oil protected indazolone type couplers, cyanoacetyl type couplers, and preferably 5-pyrazolone type couplers (4-equivalent) and pyrazoloazole type couplers such as pyrazolotriazoles are exemplified.

Examples of pyrazoloazole type couplers include pyrazolobenzimidazoles as described in U.S. Pat. No. 3,369,897, and preferably pyrazolo[5,1-c][1,2,4]triazoles as described in U.S. Pat. No. 3,725,067, pyrazolotetrazoles as described in *Research Disclosure*, RD No. 24220 (June 1984) and pyrazolopyrazoles as described in *Research Disclosure*, RD No. 24230 (June 1984). Imidazo[1,2-b]pyrazoles as described in European Pat. No. 119,741 are preferred and pyrazolo[1,5-b][1,2,4]triazoles as described in European Pat. No. 119,860 are particularly preferred in view of less yellow side absorption and light fastness of dyes formed.

As cyan couplers used in the present invention, oil-protected naphthol type and phenol type couplers are exemplified. Typical examples thereof include naphthol type couplers as described in U.S. Pat. No. 2,474,293 and preferably 2-equivalent naphthol type couplers having an oxygen atom-containing coupling-off group wherein the oxygen atom is attached to the coupling position as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162, 2,895,826, etc.

Cyan couplers resistant to humidity and high temperature are preferably used in the present invention. Typical examples thereof include phenol type cyan couplers having an alkyl group higher than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011, 4,327,173 and 4,500,635, West German Patent Application (OLS) No. 3,329,729, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc.

It is preferred to use colored couplers together in color photographic light-sensitive materials for photographing in order to correct undesirable absorptions in shorter wavelength regions which dyes formed from magenta couplers and cyan couplers used have. Typical examples include yellow-colored magenta couplers as described in U.S. Pat. Nos. 4,163,670 and Japanese Patent Publication No. 39413/82, etc., and magenta-colored cyan couplers as described in U.S. Pat. Nos. 4,004,929 and 4,138,258 and British Pat. No. 1,146,368, etc.

Couplers for masking to correct unnecessary absorption of a developed dye also include compounds having a releasable group capable of coordinating to a metal to develop a color as described in U.S. Pat. Nos. 4,555,477 and 4,555,478. Unlike the aforesaid colored couplers, these compounds are colorless before coupling with an oxidation product of a developing agent. After development, the released ligand is washed away in the exposed areas to show a hue of the dye formed by coupling, while the ligand fixed to the coupler in the unexposed areas is coordinated to a metal ion in a processing solution, e.g., Fe (II), etc., to develop a color. Reduction in sensitivity due to the filter effect of colored couplers can thus be lessened. A light-sensitive material containing such a coupler can be processed through general development processing steps or processing steps including a specific bath containing a metal ion. The metal ions to be used include Fe (II), Co (II), Cu (I), Cu (II), Ru (II), etc., with Fe (II) being particularly preferred.

Further, couplers capable of forming appropriately diffusible dyes can be used together in order to improve graininess. Specific examples of such types of magenta couplers are described in U.S. Pat. No. 4,366,237 and British Pat. No. 2,125,570, etc., and those of yellow, magenta and cyan couplers are described in European Pat. No. 96,570 and West German patent application (OLS) No. 3,234,533, etc.

Dye-forming couplers and the above described special couplers may form polymers including dimers or higher polymers. Typical examples of polymerized dye forming couplers are described in U.S. Pat. Nos. 3,451,820 and 4,080,211, etc. Specific examples of polymerized magenta couplers are described in British Pat. No. 2,102,173 and U.S. Pat. No. 4,367,282, etc.

These couplers may be either 4-equivalent or 2-equivalent with respect to silver ions.

It is also possible to use colored couplers capable of exerting color correction effects, or couplers capable of releasing development inhibitors during the course of development (so-called DIR couplers).

Further, the emulsion layer may contain non-color-forming DIR coupling compounds which release a development inhibitor, the product of which formed by a coupling reaction is colorless, other than DIR couplers.

Moreover, the photographic light-sensitive material may contain compounds which release a development inhibitor during the course of development, other than DIR couplers.

Two or more kinds of the above-described various couplers and the like can be incorporated together in the same photographic layer for the purpose of satisfying the properties required of the photographic light-sensitive material, or the same compound can be incorporated into two or more layers.

In order to incorporate the couplers according to the present invention and couplers to be used together into a silver halide emulsion layer, known methods, including those as described, e.g., in U.S. Pat. No. 2,322,027 can be used. For example, they can be dissolved in a solvent and then dispersed in a hydrophilic colloid. Examples of solvents usable for this method include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetyl citrate, etc.), benzoic acid esters (e.g., octyl benzoate, etc.), alkylamides (e.g., octyl benzoate, etc.), alkylamides (e.g., diethyl laurylamides, etc.), esters of fatty acids (e.g., dibutoxyethyl succinate, diethyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate, or the like. Mixtures of the organic solvents having a high boiling point and organic solvents having a low boiling point described above can also be used.

It is also possible to utilize the dispersing method using polymers, as described in Japanese Patent Publication No. 39853/76 and Japanese Patent Application (OPI) No. 59943/76.

Of the couplers according to the present invention or the couplers to be used together, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin used in the present invention, not only lime-processed gelatin, but also acid-processed gelatin may be employed. Methods for preparation of gelatin are described in greater detail in Arthur Weiss, *The Macro-molecular Chemistry of Gelatin*, Academic Press (1964).

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide containing 15 mol % or less of silver iodide. A silver iodobromide emulsion containing from 2 mol % to 12 mol % of silver iodide is particularly preferred.

Although the mean grain size of silver halide particles in the photographic emulsion (the mean grain size being determined with a grain diameter in those particles which are spherical or nearly spherical, and an edge length in those particles which are cubic as a grain size, and is expressed as a mean value calculated from projected areas) is not particularly limited, it is preferably 3 μm or less.

The distribution of grain size may be broad or narrow.

Silver halide particles in the photographic emulsion may have a regular crystal structure, e.g., a cubic or octapheral structure, an irregular crystal structure, e.g., a spherical or tabular structure, or a composite structure thereof. In addition, silver halide particles composed of those having different crystal structures may be used.

Further, the photographic emulsion wherein at least 50% of the total projected area of silver halide particles is super tabular silver halide particles having a diameter at least 5 times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique*, Paul Montel (1966), and V. L. Zelikman, et al., *Making and Coating Photographic Emulsion*, The Focal Press (1964). That is, any of an acid process, a neutral process, an ammonia process, etc., can be employed.

Soluble silver halide and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, rhodium salts or its complex salts, iron salts or its complex salts, and the like.

Silver halide emulsions are usually chemically sensitized. For this chemical sensitization, for example, the methods as described in H. Frieser ed., *Die Grundlagen der Photographischen Prozesse mit Silberhalogeniden*, Akademische Verlagsgesellschaft, pages 675 to 734 (1968) can be used.

More specifically, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid, and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light-sensitive material during the production, storage or photographic processing thereof. For example, those compounds known as anti-foggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted (1,3,3a,7)tetraazaindenes), pentaazaindenes, etc.; benzenethiosulfonic acids; benzenesulfinic acids; benzenesulfonic amides; etc.

In the photographic emulsion layers or other hydrophilic colloid layers of the photographic light-sensitive material of the present invention can be incorporated various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

The photographic emulsion layer of the photographic light-sensitive material of the present invention may contain compounds such as polyalkylene oxide or its ether, ester, amine or like derivatives, thioether compounds, thiomorphilines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic light-sensitive material of the present invention can be incorporated water-insoluble or sparingly soluble synthetic polymer dispersions for the purpose of improving dimensional stability, etc. Synthetic polymers which can be used include homo- or copolymers of alkyl acrylates or methacrylates, alkoxyalkyl acrylates or methacrylates, glycidyl acrylate or methacrylate, acrylamide or methacrylamide, vinyl esters (e.g., vinyl acetate), acrylonitrile, olefins, styrene, etc. and copolymers of the foregoing monomers and acrylic acid, methacrylic acid, α,β-unsaturated dicarboxylic acid, hydroxyalkyl acrylates or methacrylates, sulfoalkyl acrylates or methacrylates, and styrenesulfonic acid, etc.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present.

The photographic light-sensitive material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic light-sensitive material of the invention, when dyes, ultraviolet ray absorbing agents, and the like are incorporated in the hydrophilic colloid layers, they may be mordanted with cationic polymers, etc.

The photographic light-sensitive material of the present invention may contain therein hydroquinone derivatives, aminophenol derivatives, gallic acid derivatives, ascorbic acid derivatives, etc., as color fog preventing agents.

The hydrophilic colloid layers of the photographic light-sensitive material of the present invention can contain ultraviolet ray absorbing agents. For example, benzotriazole compounds substituted with aryl groups (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229) or benzoxazole compounds (e.g., those described in U.S. Pat. No. 3,700,455) can be employed. Ultraviolet ray absorbing couplers (e.g., $\alpha$-naphthol type cyan dye forming couplers) and ultraviolet ray absorbing polymers can also be employed. These ultraviolet ray absorbing agents can also be mordanted in a specific layer(s), if desired.

The photographic light-sensitive material of the present invention may contain water-soluble dyes in the hydrophilic colloid layers thereof as filter dye or for various purposes, e.g., irradiation prevention. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In carrying out the present invention, known color fading preventing agents described below can be used. Color image stabilizers can be used alone or in combination with each other. Typical known color fading preventing agents include hydroquinone derivatives, gallic acid derivatives, p-alkoxyphenols, p-oxyphenol derivatives, and bisphenols, etc.

For the photographic processing of the photographic light-sensitive material of the present invention, any of known procedures and known processing solutions, for example, as those described in *Research Disclosure*, RD No. 176, pages 28 to 30, etc., can be utilized. The processing temperature can usually be selected from the range of 18° to 50° C., but the temperature may be lower than 18° C. or higher than 50° C.

Color developing solutions are usually composed of alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-$\beta$-methanesulfonamidoethylaniline, 4-amino-3-methyl-N-$\beta$-methoxyethylaniline, etc., can be used. of these, 3-methyl-N-ethyl-N-$\beta$-hydroxyethylaniline is preferred.

In addition, the compounds as described in F. A. Mason, *Photographic Processing Chemistry*, Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc., developing inhibitors or anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone, etc.; viscosity-imparting agents; polycarboxylic acid type chelating agents; anti-oxidizing agents; and the like.

After color development, the photographic emulsion layer is usually subjected to a bleach processing. This bleach processing may be performed simultaneously with a fix processing, or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates, organic complex salts of iron (III) or cobalt (III), e.g., complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, maleic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a mono-bath bleach-fixing solution.

Any conventional fixing solution can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

In the present invention, the fixing or bleach-fix is followed by washing or stabilization.

Washing may be carried out with a large quantity of water as is usual, but it is especially preferable that washing or stabilization is carried out in a multiple countercurrent system using a plurality of tanks in which a processing solution is replenished in an amount of from 3 to 50 times the amount of the processing solution brought out from the preceding bath per unit area of the silver halide color photographic material to be processed.

When the silver halide color photographic materials according to the present invention are processed by processing steps including the above-described step of washing or stabilizing, it was confirmed that variations in minimum color density can be markedly suppressed as compared with the cases where such a processing system is applied to other light-sensitive materials, with the resulting minimum color density being approximately equal to that attained by washing using a sufficiently large quantity of water. Although a clear conclusion in elucidation of these results has not yet been reached, it is assumed from analyses of the minimum color density areas that these favorable results are attributed to a lesser amount of a spectral sensitizer of silver halides which remains in the light-sensitive material after processing. It is entirely unexpected that such results can be accomplished with the light-sensitive materials of the present invention.

In the washing or stabilization step, various known compounds may be used for the purpose of preventing precipitation or stabilizing washing water, if desired. Such compounds include chelating agents, such as inorganic phosphoric acids, aminopolycarboxylic acids, organic phosphonic acids, etc.; various antibacterial, antialgal or antifungal agents which prevent generation of bacteria, algae or fungi, such as the compounds described in *Journal of Antibacterial and Antifungal Agents*, Vol. 11, No. 5, 207–223 (1983) and the compounds described in H. Horiguchi, *Bokin Bobai no Kagaku* (Antibacterial and Antifungal Chemistry); metal salts exemplified by magnesium salts, aluminum salts, bismuth salts, etc.; alkali metals; ammonium salts; surface active agents for prevention of uneven drying; and the like. In addition, the compounds described in West, *Photographic Science and Engineering*, Vol. 6, 344–359 (1965) may also be added. Among these compounds, chelating agents and antibacterial or antifungal agents are particularly effective.

The washing is generally performed by a multiple countercurrent system using 2 or more, e.g., 2 to 9 tanks. The washing may be replaced by a multiple countercurrent stabilization step as disclosed in Japanese Patent Application (OPI) No. 8543/82. A stabilizing bath to be used for the stabilization can contain not only the above-enumerated additives but also other various compounds for the purpose of stabilizing images. Typical examples of such compounds to be added include various buffering agents for adjusting the film pH value, e.g., to 3 to 9, such as borates, metaborates, borax, phosphates, carbonates, potassium hydroxide, sodium hydroxide, aqueous ammonia, monocarboxylic acids, dicarboxylic acids, polycarboxylic acids, and combinations thereof; and aldehydes, such as formaldehyde. In addition, the stabilizing bath may further contain a chelating agent (e.g., inorganic phosphoric acids, aminopolycarboxylic acids, organic phosphonic acids, aminopolyphosphonic acids, phosphonocarboxylic acids, etc.), antibacterial agents, antifungal agents (e.g., thiazoles, isothiazoles, halogenated phenols, sulfanilamide, benzotriazole, etc.), a surface active agent, a fluorescent brightening agent, a hardening agent, and the like, either individually or in combination of two or more thereof.

Furthermore, in order to improve the image stability, it is preferable to add an aluminum salt, e.g., ammonium chloride, ammonium nitrate, ammonium sulfate, ammonium phosphate, ammonium sulfite, ammonium thiosulfate, etc., as a pH-adjusting agent after processing.

In the processing of color light-sensitive materials for photographing, a washing-stabilizing step commonly employed after fixing may be replaced by the above-described stabilizing step and washing step (with water saving). Such being the case, formalin may be excluded from the stabilizing bath.

The time required for the washing or stabilization according to the present invention is generally from 20 seconds to 10 minutes, and preferably from 20 seconds to 5 minutes, though varying depending on the type of light-sensitive materials to be processed or processing conditions.

Each of the processing solutions according to the invention is used at a temperature of from 10° C. to 50° C. A standard temperature is from 33° C. to 38° C., but higher temperatures can be used to shorten the processing time by acceleration, or lower temperature can be employed to improve image quality or stability of the processing solution. Intensification using a cobalt intensifier or a hydrogen peroxide intensifier as described in West German Pat. No. 2,226,770 or U.S. Pat. No. 3,674,499 may be conducted in order to save silver of light-sensitive materials. Further, combined developing, bleaching and fixing as described in U.S. Pat. No. 3,923,511 may be performed.

If desired, the processing time in each step can be made shorter than the standard within such a scope that does not cause any disorder, to thereby establish rapid processing.

For the purpose of simplifying and speeding up the processing, the silver halide color photographic material may contain a color developing agent or a precursor thereof, the latter being preferred from the standpoint of increasing stability of the light-sensitive material. Specific examples of developing agent precursors which can be incorporated include indoaniline compounds described in U.S. Pat. No. 3,342,597, Schiff's base type compounds described in U.S. Pat. No. 3,342,599, *Research Disclosure*, RD No. 14850 (August 1976) and ibid, RD No. 15159 (November 1976), aldol compounds described in *Research Disclosure*, RD No. 13924, metal complexes described in U.S. Pat. No. 3,719,492, urethane compounds described in Japanese Patent Application (OPI) No. 135628/78, and a variety of salt type precursors described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82 and 83565/82.

The silver halide color photographic material of the present invention can further contain various 1-phenyl-3-pyrazolidones in order to accelerate color development. Typical examples of the 1-phenyl-3-pyrazolidone to be incorporated are described, e.g., in Japanese Patent Application (OPI) Nos. 64339/81, 144547/82, 211147/82, 50532/83, 50536/83, 50533/83, 50534/83, 50535/83 and 115438/83.

In case of continuous processing, uniform quality of finished material can be assured by using a replenisher for each processing solution to thereby prevent variations of liquid composition. For cost reduction and the like, the amount of the replenisher may be decreased to a half or less the standard amount of the replenisher.

If desired, each processing bath may be equipped with a heater, a temperature sensor, a liquid level sensor, a circulating pump, a filter, a floating cover, a squeegee, etc.

When the light-sensitive material according to the present invention is color paper, it is quite common to conduct bleach-fix. Bleach-fix can also be applied to color photographic materials for photographing, if desired.

The present invention will be explained in greater detail with reference to the following example, but the present invention should not be construed as being limited thereto.

EXAMPLE 1

On a cellulose acetate film support, an emulsion layer and a protective layer each having the composition shown below were coated to prepare a sample.

SAMPLE 101

Emulsion Layer 8 g of an oil-soluble 4-equivalent Magenta Coupler A described below and 6 ml of tricresyl phosphate were dissolved by heating in 40 ml of ethyl acetate and the solution was added to 100 ml of an aqueous solution containing 10 g of gelatin and 0.4 g of sodium triisopropylnaphthalene sulfonate. The resulting mixture was stirred with high speed using a homogenizer to prepare a dispersion. 70 g of thus-prepared dispersion was mixed with 100 g of a silver halide emulsion containing $5.6\times10^{-2}$ mol of silver iodobromide (iodide content: 4 mol %) and 10 g of gelatin. To the mixture were added a gelatin hardener and a surface active agent and the pH thereof was adjusted to 6.5, whereby a coating solution for emulsion layer was obtained.

Protective Layer 20 ml of an aqueous solution containing 15 g of gelatin, a gelatin hardener and a surface active agent was prepared and the pH thereof was adjusted to 6.5, whereby a coating solution for the protective layer was obtained.

Magenta Coupler A:

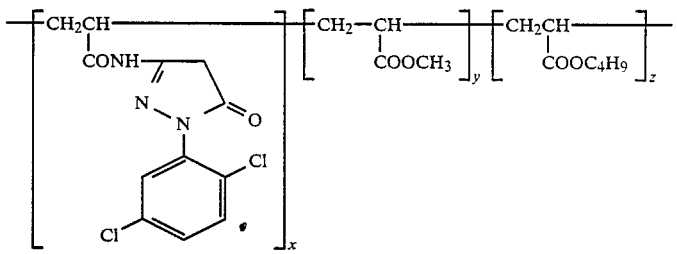

x/y/z = 50/25/25 (wt)

SAMPLE 102

Sample 102 was prepared in the same manner as described for Sample 101 except that the equimolar amount of 2-equivalent Magenta Coupler M-38 (as described in U.S. Pat. No. 4,367,282) was used in place of the 4-equivalent Magenta Coupler A in Sample 101.

SAMPLE 103

Sample 103 was prepared in the same manner as described for Sample 101 except that a protective layer was prepared by adding Formaldehyde Scavenger S-27 (as described in U.S. Pat. No. 4,411,987) so as to render a coating amount of 0.3 g/m$^2$ to the protective layer of Sample 101.

SAMPLE 104

Sample 104 was prepared in the same manner as described for Sample 102 except that a protective layer was prepared by adding Formaldehyde Scavenger S-27 so as to render a coating amount of 0.3 g/m$^2$ to the protective layer of Sample 102.

SAMPLE 105

Sample 105 was prepared in the same manner as described for Sample 104 except that 0.3 g/m$^2$ of Formaldehyde Scavenger S-5 was used in place of Formaldehyde Scavenger S-27 in Sample 104.

SAMPLE 106

Sample 106 was prepared in the same manner as described for Sample 104 except that 0.3 g/m$^2$ of Formaldehyde Scavenger S-4 was used in place of Formaldehyde Scavenger S-27 in Sample 104.

SAMPLE 107

Sample 107 was prepared in the same manner as described for Sample 104 except that 0.3 g/m$^2$ of Formaldehyde Scavenger S-7 (as described in U.S. Pat. No. 4,490,460) was used in place of Formaldehyde Scavenger S-27 in Sample 104.

SAMPLE 108

Sample 108 was prepared in the same manner as described for Sample 104 except that the equimolar amount of 2-equivalent Magenta Coupler M-28 was used in place of Magenta Coupler M-38 in Sample 104.

Samples 101 to 108 described above were brought into contact with formaldehyde vapor of (A) 0 ppm and (B) 10 ppm, respectively, for 24 hours under the conditions of 40° C. and 70% relative humidity. Then, the samples were exposed imagewise to light and subjected to color development processing at 38° C. using the following processing steps.

| Processing Step | Time |
|---|---|
| Color development | 3 min 15 sec |
| Bleaching | 6 min 30 sec |
| Washing with water | 2 min 10 sec |
| Fixing | 4 min 20 sec |
| Washing with water | 3 min 15 sec |
| Stabilizing | 1 min 05 sec |

The processing solutions used in the color development processing had the following compositions:

| Color Developing Solution | |
|---|---|
| Diethylenetriaminepentaacetic Acid | 1.0 g |
| 1-Hydroxyethylidene-1,1-diphosphoric Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |

-continued

| Bleaching Solution | |
|---|---|
| Iron (III) Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| **Fixing Solution** | |
| Disodium Ethylenediaminetetraacetate | 1.0 g |
| Sodium Sulfite | 4.0 g |
| Ammonium Thiosulfate (70% aq. soln.) | 175.0 ml |
| Sodium Bisulfite | 4.6 g |
| Water to make | 1.0 liter |
| | pH 6.6 |
| **Stabilizing Solution** | |
| Formalin (40%) | 2.0 ml |
| Polyoxyethylene-p-monononylphenylether (average degree of polymerization = 10) | 0.3 g |
| Water to make | 1.0 liter |

The rate of decrease in maximum magenta color density:

$$1 - \frac{Dm^B}{Dm^A} \times 100\ (\%),$$

and the increase in fog:

$$Fog^B - Fog^A$$

due to formaldehyde vapor were determined with respect to the above samples, wherein $Dm^A$ and $Fog^A$ represent the maximum magenta color density and fog density under Condition (A) respectively, and $Dm^B$ and $Fog^A$ represents the maximum magenta color density and fog density under Condition (B) respectively. The results thus obtained are shown in Table 1.

TABLE 1

| Sample | Coupler | Formaldehyde Scavenger | $1 - \frac{Dm^B}{Dm^A} \times 100$ | $Fog^B - Fog^A$ |
|---|---|---|---|---|
| 101 (Comparison) | A | none | 43 | 0.10 |
| 102 (Comparison) | M-38 | " | 2 | 0.32 |
| 103 (Comparison) | A | S-27 | 12 | 0.08 |
| 104 (Present Invention | M-38 | S-27 | 0 | 0.06 |
| 105 (Present Invention) | " | S-5 | 1 | 0.07 |
| 106 (Comparison) | " | S-4 | 2 | 0.07 |
| 107 (Present Invention) | " | S-7 | 2 | 0.08 |
| 108 (Present Invention) | M-28 | S-27 | 3 | 0.05 |

From the results as shown in Table 1 above, it is apparent that the rate of decrease in color density and the increase in fog due to formaldehyde vapor are remarkably improved by the combination of the 2-equivalent 5-pyrazolone magenta couplers and the formaldehyde scavengers as defined in the present invention.

EXAMPLE 2

SAMPLE 201

On a cellulose triacetate film support were coated layers having the compositions set forth below to prepare a multilayer color photographic light-sensitive material.

First Layer: Antihalation Layer

A gelatin layer containing block colloidal silver.

Second Layer: Intermediate Layer

A gelatin layer

Third Layer: First Red-Sensitive Emulsion Layer

| | |
|---|---|
| A silver iodobromide emulsion (iodide content: 6 mol %, average particle size: 0.6 μm), silver coated amount: | 0.023 mol/m$^2$ |
| Sensitizing Dye I: | $6 \times 10^{-5}$ mol per mol of silver |
| Sensitizing Dye II: | $1.5 \times 10^{-5}$ mol per mol of silver |
| Coupler B: | 0.05 mol per mol of silver |
| Coupler C: | 0.003 mol per mol of silver |
| Coupler D: | 0.002 mol per mol of silver |
| Di-n-butyl phthalate: | 1.0 g per g of Couplers |

Fourth Layer: Second Red-Sensitive Emulsion Layer

| | |
|---|---|
| A silver iodobromide emulsion (iodide content: 8 mol %, average particle size: 1.0 μm), silver coated amount: | 0.011 mol/m$^2$ |
| Sensitizing Dye I: | $6 \times 10^{-5}$ mol per mol of silver |
| Sensitizing Dye II: | $1.5 \times 10^{-5}$ mol per mol of silver |
| Coupler E: | 0.02 mol per mol of silver |
| Coupler C: | 0.002 mol per mol of silver |
| Di-n-butyl phthalate: | 1.0 g per g of Couplers |

Fifth Layer: Intermediate Layer

A gelatin layer containing $2.2 \times 10^{-4}$ mol/m$^2$ of 2,5-di-tert-octylhydroquinone and tricresyl phosphate Sixth Layer: First Green-Sensitive Emulsion Layer

| | |
|---|---|
| A silver iodobromide emulsion (iodide content: 6 mol %, average particle size: 0.6 μm), silver coated amount: | 0.011 mol/m$^2$ |
| Sensitizing Dye III: | $3 \times 10^{-5}$ mol per mol of silver |
| Sensitizing Dye IV: | $1 \times 10^{-5}$ mol per mol of silver |
| Coupler A: | 0.09 mol per mol of silver |
| Coupler F: | 0.03 mol per mol of silver |
| Coupler G: | 0.01 mol per mol of silver |
| Tricresyl phosphate: | 1.5 g per g of Couplers |

-continued

Seventh Layer: Second Green-Sensitive Emulsion Layer

| | |
|---|---|
| A silver iodobromide emulsion (iodide content: 8 mol %, average particle size: 1.0 μm), silver coated amount: | 0.009 mol/m$^2$ |
| Sensitizing Dye III: | $3 \times 10^{-5}$ mol per mol of silver |
| Sensitizing Dye IV: | $1 \times 10^{-5}$ mol per mol of silver |
| Coupler A: | 0.02 mol per mol of silver |
| Coupler F: | 0.006 mol per mol of silver |
| Tricresyl phosphate: | 1.5 g per g of Couplers |

Eighth Layer: Yellow Filter Layer

A gelatin layer containing yellow colloidal silver and an emulsified dispersion of 2,5-di-tert-octylhydroquinone and tricresyl phosphate Ninth Layer: First Blue-Sensitive Emulsion Layer

| | |
|---|---|
| A silver iodobromide emulsion (iodide content: 6 mol %, average particle size: 0.7 μm), silver coated amount: | 0.014 mol/m$^2$ |
| Coupler I: | 0.25 mol per mol of silver |
| Coupler J: | 0.002 mol per mol of silver |
| Tricresyl phosphate: | 0.5 g per g of Couplers |

Tenth Layer: Second Blue-Sensitive Emulsion Layer

| | |
|---|---|
| A silver iodobromide emulsion (iodide content: 8 mol %, average particle size: 1.2 μm), silver coated amount: | 0.010 mol/m$^2$ |
| Coupler J: | 0.06 mol per mol of silver |
| Tricresyl phosphate: | 0.5 g per g of Couplers |

Eleventh Layer: First Protective Layer

The sensitivities are indicated by using relative value for Condition (B) by taking the sensitivity of Condition (A) as 100.

The couplers as shown in each layer were employed by dissolving them in the solvent having a high boiling point as described above and ethyl acetate by heating and mixing the resulting solution with a 10% aqueous solution of gelatin containing sodium p-dodecylbenzenesulfonate as an emulsifier, and emulsified using a colloid mill.

Gelatin Hardener H-1 and a surface active agent were incorporated into each of the layers in addition to the above-described components.

The components used for preparing the sample are as follows:

| | |
|---|---|
| Sensitizing Dye I: | Pyridinium salt of anhydro-5,5'-di-chloro-3,3'-di(γ-sulfopropyl)-9-ethyl-thiacarbocyanine hydroxide |
| Sensitizing Dye II: | Triethylamine salt of anhydro-9-ethyl-3,3'-di(γ-sulfopropyl)-4,5,4',5'-di-benzothiacarbocyanine hydroxide |
| Sensitizing Dye III: | Sodium salt of anhydro-9-ethyl-5,5'-dichloro-3,3'-di(γ-sulfopropyl)oxacarbocyanine |
| Sensitizing Dye IV: | Sodium salt of anhydro-5,6,5',6'-tetrachloro-1,1'-diethyl-3,3'-di{β[β-(γ-sulfopropoxy)ethoxy]ethyl}imidazolo-carbocyanine hydroxide |

-continued
Coupler B
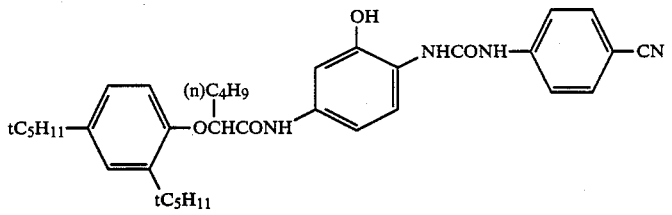
Coupler C
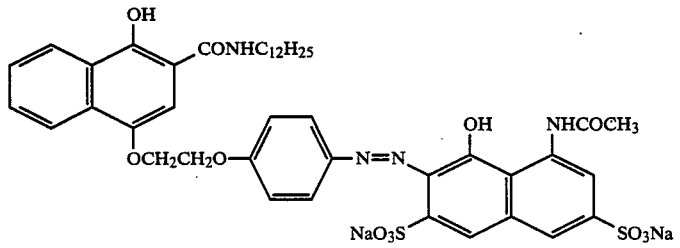
Coupler D
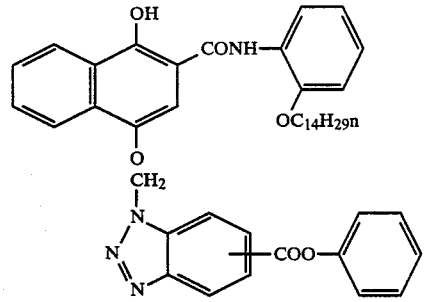
Coupler E
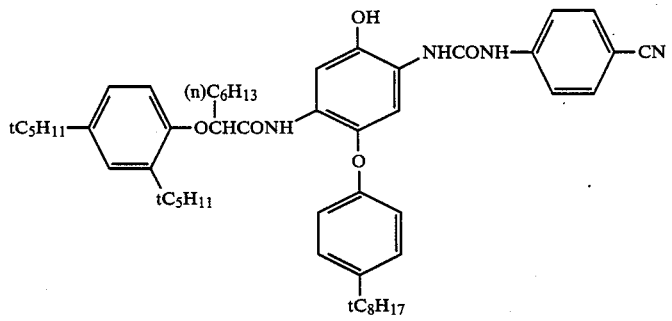
Coupler F
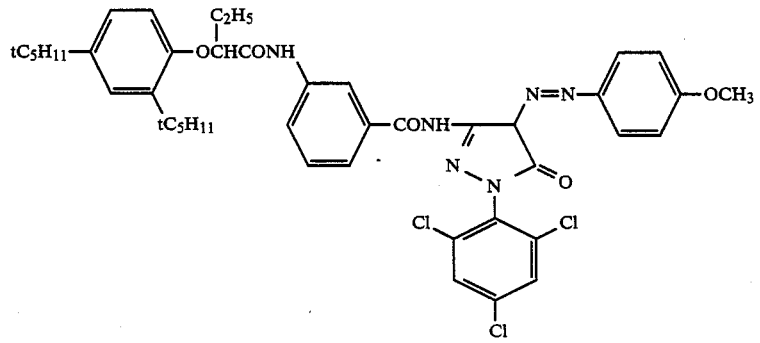

-continued
Coupler G
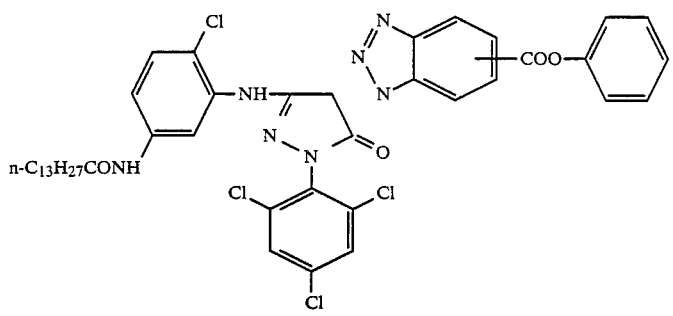
Coupler H
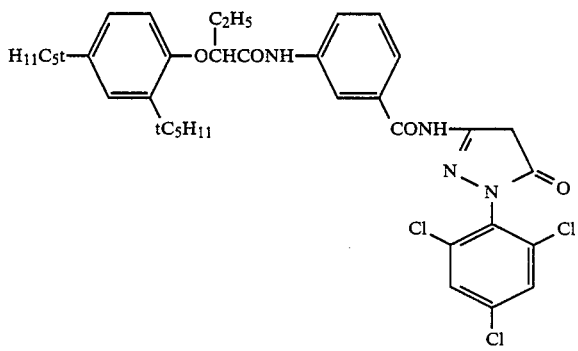
Coupler I
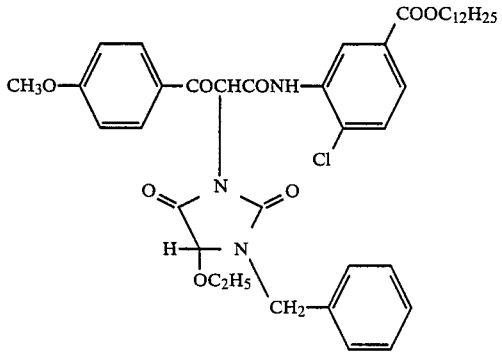
Coupler J
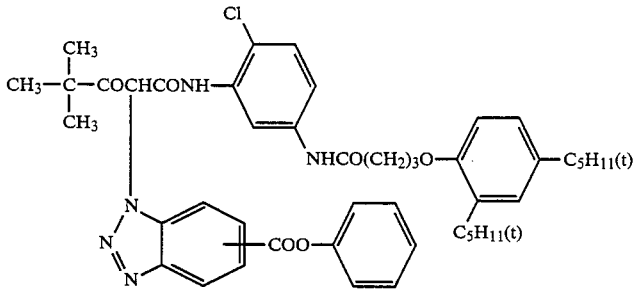
UV-1
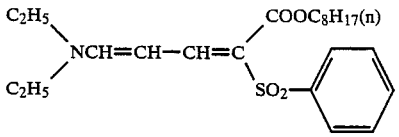
H-1 $CH_2{=}CHSO_2CH_2CONHCH_2CH_2NHCOCH_2SO_2CH{=}CH_2$
SAMPLE 202
Sample 202 was prepared in the same manner as described for Sample 201 except that Formaldehyde Scavenger S-27 was added so as to render a coating amount of 0.6 g/m$^2$ to the Eleventh Layer (First Protective Layer) of Sample 201.

SAMPLE 203

Sample 203 was prepared in the same manner as described for Sample 201 except that one half of the total amount of Coupler A was replaced with Magenta Coupler M-38 in the Sixth Layer (First Green-Sensitive Emulsion Layer) of Sample 201. In this case, a ratio of 2-equivalent uncolored 5-pyrazolone magenta coupler taken in the total amount of uncolored magenta couplers was 39%.

SAMPLE 204

Sample 204 was prepared in the same manner as described for Sample 201 except that the total amount of Coupler A was replaced with Magenta Coupler M-38 in the Sixth Layer (First Green-Sensitive Emulsion Layer) of Sample 201. In this case, the ratio of 2-equivalent coupler was 77%.

SAMPLE 205

Sample 205 was prepared in the same manner as described for Sample 201 except that the total amount of Coupler A was replaced with Magenta Coupler M-38 in the Sixth Layer (First Green-Sensitive Emulsion Layer), and one half of the total amount of Coupler H was replaced with Magenta Coupler M-28 (as described in Japanese Patent Application (OPI) No. 17950/82) and further the remainder was replaced with Magenta Coupler M-3 in the Seventh Layer (Second Green-Sensitive Emulsion Layer) of Sample 201.

SAMPLE 206

Sample 206 was prepared in the same manner as described for Sample 203 except that Formaldehyde Scavenger S-27 was added so as to render a coating amount of 0.6 g/m$^2$ to the Eleventh Layer (First Protective Layer) of Sample 203.

SAMPLE 207

Sample 207 was prepared in the same manner as described for Sample 204 except that Formaldehyde Scavenger S-27 was added so as to render a coating amount of 0.6 g/m$^2$ to the Eleventh Layer (First Protective Layer) of Sample 204.

SAMPLE 208

Sample 208 was prepared in the same manner as described for Sample 205 except that Formaldehyde Scavenger S-27 was added so as to render a coating amount of 0.6 g/m$^2$ to the Eleventh Layer (First Protective Layer) of Sample 205.

SAMPLE 209

Sample 209 was prepared in the same manner as described for Sample 208 except that the equimolar amount of Magenta Coupler M-35 was used in place of Magenta Coupler M-38 in the Sixth Layer (First Green-Sensitive Emulsion Layer) of Sample 208.

SAMPLES 210 AND 211

Samples 210 and 211 were prepared in the same manner as described for Samples 208 and 209, respectively, except that the coating amount of Formaldehyde Scavenger S-27 was reduced to 0.3 g/m$^2$, and Formaldehyde Scavenger S-5 was added in a coating amount of 0.3 g/m$^2$ to the Eleventh Layer (First Protective Layer) of each of Samples 208 and 209.

SAMPLE 212

Sample 212 was prepared in the same manner as described for Sample 210 except that the equimolar amount of Magenta Coupler M-39 was used in place of Magenta Coupler M-3 in the Seventh Layer (Second Green-Sensitive Emulsion Layer) of Sample 210.

These samples thus prepared were brought into contact with formaldehyde vapor of (A) 0 ppm and (B) 20 ppm, respectively, for 24 hours under the condition of 40° C. and 70% relative humidity. Then, the samples were exposed imagewise to green light and subjected to the same color development processing as described in Example 1.

The rate of decrease in color density:

$$1 - \frac{D^B}{D^A}$$

due to the contact with formaldehyde vapor was determined with respect to the above samples, wherein $D^B$ represents color density under Condition (B) obtained by the same exposure amount as that required for providing with color density under Condition (A) represented by $D^A$ of 2.0. Further, a difference between fog under Condition (A) and fog under Condition (B):

$$Fog^B - Fog^A = \Delta Fog$$

was determined as described in Example 1. The results thus obtained are shown in Table 2.

TABLE 2

| Sample | Uncolored Coupler in Sixth Layer | Uncolored Coupler in Seventh Layer | Ratio of 2-Equivalent Coupler (%) | Formal-dehyde Scavenger | Rate of* Decrease in Magenta Density (%) | Magenta Fog (Fog M) | Cyan Fog (Fog C) | Yellow Fog (Fog Y) |
|---|---|---|---|---|---|---|---|---|
| 201 (Comparison) | A | H | 0 | none | 39 | 0.05 | 0.08 | 0.03 |
| 202 (Comparison) | " | " | 0 | S-27 | 20 | 0.03 | 0.06 | 0.02 |
| 203 (Comparison) | A/M-38 | " | 39 | none | 26 | 0.09 | 0.09 | 0.04 |
| 204 (Comparison) | M-38 | " | 77 | none | 15 | 0.14 | 0.12 | 0.06 |
| 205 (Comparison) | M-38 | M-28/M-3 | 100 | none | 1 | 0.22 | 0.14 | 0.06 |
| 206 (Present Invention) | A/M-38 | H | 39 | S-27 | 14 | 0.05 | 0.04 | 0.03 |
| 207 (Present Invention) | M-38 | " | 77 | " | 5 | 0.04 | 0.04 | 0.02 |

TABLE 2-continued

| Sample | Uncolored Coupler in Sixth Layer | Uncolored Coupler in Seventh Layer | Ratio of 2-Equivalent Coupler (%) | Formal-dehyde Scavenger | Rate of* Decrease in Magenta Density (%) | Magenta Fog (Fog M) | Cyan Fog (Fog C) | Yellow Fog (Fog Y) |
|---|---|---|---|---|---|---|---|---|
| 208 (Present Invention) | M-38 | M-28/M-3 | 100 | " | 0 | 0.01 | 0.04 | 0.02 |
| 209 (Present Invention) | M-35 | M-28/M-3 | 100 | S-5/S-27 | 0 | 0.03 | 0.02 | 0.01 |
| 210 (Present Invention) | M-38 | " | " | " | 0 | 0.01 | 0.01 | 0.01 |
| 211 (Present Invention) | M-35 | " | " | " | 0 | 0.03 | 0.01 | 0.01 |
| 212 (Present Invention) | M-38 | M-28/M-39 | " | " | 0 | 0.00 | 0.01 | 0.01 |

*$1 - \frac{D^B}{D^A} \times 100$

From the results as shown in Table 2 above, it is apparent that silver halide color photographic materials having excellent photographic properties are obtained when the 5-pyrazolone 2-equivalent magenta coupler and the formaldehyde scavenger are employed in combination and particularly remarkably in cases wherein the content of the 5-pyrazolone 2-equivalent magenta coupler used in 70% or more.

EXAMPLE 3

On a polyethylene terephthalate film support, an emulsion layer and a protective layer were coated in the same procedure as described in Example 1 to prepare a sample.

SAMPLE 301

Sample 301 was prepared in the same manner as described for Sample 102.

SAMPLE 302

Sample 302 was prepared in the same manner as described for Sample 102 except that the equimolar amount of Coupler K described below was used in place of Magenta Coupler M-38 in Sample 102.

Magenta Coupler K:

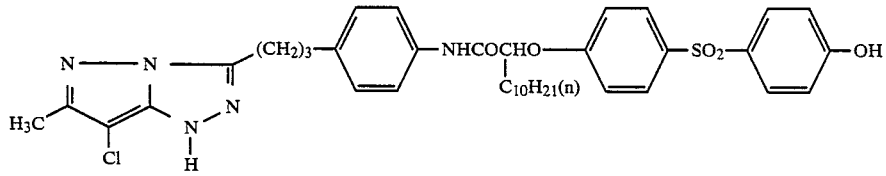

which is described in U.S. Pat. No. 3,725,067.

SAMPLE 303

Sample 303 was prepared in the same manner as described for Sample 302 except that Formaldehyde Scavenger S-4 was added so as to render a coating amount of 0.3 g/m$^2$.

SAMPLE 304

Sample 304 was prepared in the same manner as described for Sample 106.

SAMPLE 305

Sample 305 was prepared in the same manner as described for Sample 104.

Samples 301 to 305 described above were exposed imagewise to white light and (A) immediately and (B) after preservation at 35° C. and 80% relative humidity for 1 week, respectively, subjected to the same color development processing as described in Example 1, whereby a difference in sensitivities due to the variation of the condition was evaluated. The results thus obtained are shown in Table 3. The sensitivities are indicated by using relative value for Condition (B) by taking the sensitivity of Condition (A) as 100.

TABLE 3

| Sample | Coupler | Formaldehyde Scavenger | Relative Sensitivity |
|---|---|---|---|
| 301 (Comparison) | M-38 | none | 90 |
| 302 (Comparison) | K | none | 64 |
| 303 (Comparison) | K | S-4 | 49 |
| 304 (Present Invention) | M-38 | S-4 | 92 |
| 305 (Present Invention) | M-38 | S-27 | 96 |

From the results as shown in Table 3 above, it is apparent that the pyrazolotriazole 2-equivalent magenta exhibits large latent image fading which is further accelerated by the addition of formaldehyde scavenger. On the contrary, the combinations according to the present invention provide an excellent latent image durability.

EXAMPLE 4

Samples 401, 402, 405 and 408 were prepared in the same manner as for Samples 201, 202, 205 and 208 of Example 2, respectively, except that the Eighth Layer further contained 0.45 g/m$^2$ of Compound (1) of the formula (III) according to the present invention.

Each of these samples was contacted with formaldehyde for 24 hours under the conditions of (A) and (B) of Example 2, followed by exposure and development in the same manner as in Example 2. The densities were measured, and the percent reduction of magenta density as obtained in the same manner as in Example 2 is shown in Table 4.

Each of the samples was exposed to light at 20 CMS, emitted from a tungsten lamp through a color temperature conversion filter so as to have a color temperature of 4800° K. and then subjected to color development processing in the same manner as in Example 1 but changing the time for bleaching to 1 minute and a5 seconds. The amount of silver remaining in the processed strips were measured, and the results obtained are shown in Table 4.

Further, 30 roll films of 24 exposures (Fuji Color HR-100, produced by Fuji Photo Film Co., Ltd.) per day were continuously processed for consecutive 20 days according to Processing A or B comprising the following steps to prepare Running Solution A or B, respectively. The roll films consisted of those sufficiently exposed to white light in the proportion of one for every three, with the rest being unexposed.

In the following table for processing conditions, the amount of replenisher for washing (2) was about 65 times or about 13 times the amount brought in together with the light-sensitive material in Processing A or B, respectively.

-continued

| | Mother Solution | Replenisher |
|---|---|---|
| Ammonium (ethylenediamine-tetraacetato)ferrite | 100 g | 110 g |
| Sodium ethylenediaminetetra-acetate | 10.0 g | 10.0 g |
| Aqueous ammonia | 7 ml | 5 ml |
| Ammonium nitrate | 10.0 g | 12.0 g |
| Ammonium bromide | 150 g | 170 g |
| Water to make | 1 liter | 1 liter |
| pH | 6.0 | 5.8 |
| Fixing Solution | | |
| Sodium ethylenediaminetetra-acetate | 1.0 g | 1.2 g |
| Sodium sulfite | 4.0 g | 5.0 g |
| Sodium bisulfite | 4.6 g | 5.8 g |
| Ammonium thiosulfate aqueous solution (70 wt %) | 175 ml | 200 ml |
| Water to make | 1 liter | 1 liter |
| pH | 6.6 | 6.6 |
| Washing Solution: | | |
| 2-Methylisothiazolin-3-one | 10 mg | 10 mg |
| 5-Chloro-2-methyhlisothiazolin-3-one | 10 mg | 10 mg |
| Water to make | 1 liter | 1 liter |
| pH (NaOH) | 7.0 | 7.0 |
| Stabilizing Solution: | | |
| Formalin (37 wt %) | 2.0 ml | 3.0 ml |
| Polyoxyethylene-p-monononyl-phenyl ether (average degree of polymerization: 10) | 0.3 g | 0.45 g |
| Water to make | 1 liter | 1 liter |

CONDITIONS FOR PROCESSING A AND B

| Step | Time | Temperature | Tank Capacity | Amount of Replenisher* Processing A | Processing B |
|---|---|---|---|---|---|
| Color Development | 3'15" | 38° C. | 18 l | 42 ml | 42 ml |
| Bleach | 6'30" | 38° C. | 36 l | 20 ml | 20 ml |
| Fixing | 3'15" | 38° C. | 18 l | 36 ml | 36 ml |
| Washing (1)** | 1'30" | 38° C. | 9 l | — | — |
| Washing (2)** | 1'30" | 38° C. | 9 l | 150 ml | 30 ml |
| Stabilizing | 40" | 38° C. | 9 l | 36 ml | 36 ml |

Note:
*Amount per roll of HR-100, 24 exposures
**Countercurrent system from (2) to (1)

Formulations for the processing solutions used in the above processing were as follows:

| | Mother Solution | Replenisher |
|---|---|---|
| Color Developing Solution: | | |
| Diethylenetriamine tetraacetate | 1.0 g | 1.0 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethyl-amino)-2-methylaniline sulfate | 4.5 g | 5.0 g |
| Water to make | 1 liter | 1 liter |
| pH | 10.00 | 10.05 |
| Bleaching Solution: | | |

Each of Samples 201, 202, 205, 208, 401, 402, 405 and 408 was processed in accordance with the foregoing processing conditions but using the thus prepared Running Solution A or B, and the minimum color density of every processed sample was determined. The results obtained are shown in Table 4 below.

It can be seen from Table 4 that reduction in magenta density caused by contact with formaldehyde is significantly reduced and an increase in fog is also reduced in Samples 208 and 408 according to the present invention. It can further be seen that Sample 405 which contains Compound (1) of the present invention but contains no formaldehyde scavenger suffers a serious increase of fog, while Sample 408 of the invention is free from fog increase. The results of Table 4 additionally prove that Sample 408 is preferable to Sample 208, though both being within the scope of this invention, when processed with the desilvering time being shortened or the amount of washing water being reduced.

TABLE 4

| Sample No. | Percent Reduction of Magenta Density (1-DB/DA) × 100 (%) | Magenta Fog Fog M | Residual Silver Amount When Bleached For 1'05" ($g/cm^2$) | Minimum Color Density Processing A | Minimum Color Density Processing B | Remark |
|---|---|---|---|---|---|---|
| 201 | 39 | 0.05 | 6.1 | 0.56 | 0.56 | Comparison |
| 202 | 20 | 0.03 | 6.0 | 0.55 | 0.56 | " |
| 205 | 1 | 0.22 | 6.0 | 0.57 | 0.57 | " |
| 208 | 0 | 0.01 | 6.0 | 0.57 | 0.57 | Invention |
| 401 | 40 | 0.07 | 4.3 | 0.56 | 0.60 | Comparison |
| 402 | 19 | 0.03 | 3.9 | 0.56 | 0.58 | " |
| 405 | 1 | 0.34 | 4.2 | 0.57 | 0.60 | " |
| 408 | 0 | 0.01 | 3.5 | 0.57 | 0.57 | Invention |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein the silver halide color photographic material contains an uncolored magenta coupler and at least one compound capable of reacting with and fixing formaldehyde vapor, and at least 70 mol % based on the total amount of the uncolored magenta coupler present in the silver halide color photographic light-sensitive material is an uncolored 5-pyrazolone 2-equivalent magenta coupler.

2. A silver halide color photographic material as in claim 1, wherein the compound capable of reacting with and fixing formaldehyde vapor is represented by formula (I) or (II)

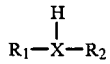

(I)

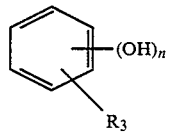

(II)

wherein $R_1$ and $R_2$ each has up to 20 carbon atoms and represents a hydrogen atom, an alkyl group, a substituted alkyl group, an aralkyl group, a substituted aralkyl group, an aryl group, a substituted aryl group, an acyl group, an alkoxycarbonyl group, a carbamoyl group, an amino group or a halogen atom, or $R_1$ and $R_2$ are bonded each other to form a ring and at least one of $R_1$ and $R_2$ is an acyl group, an alkoxycarbonyl group, a carbamoyl group or an amino group; and X represents

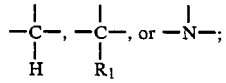

$R_3$ has up to 32 carbon atoms and represents an alkyl group, a substituted alkyl group, an aralkyl group, a substituted aralkyl group, an aryl group or a substituted aryl group, these aryl group and substituted aryl group may form a condensed ring together with a 5-membered, 6-membered or 7-membered ring; and n represents an integer of 2 to 8, and has an equivalent molecular weight of not more than 300 per unit of active hydrogen atom as defined by the equation below.

$$\text{Equivalent Molecular Weight} = \frac{\text{Molecular Weight}}{\text{Number of Active Hydrogen Atoms in Molecule}}$$

3. A silver halide color photographic material as in claim 2, wherein the substituent for the substituted alkyl group, the substituted aralkyl group, or the substituted aryl group for $R_1$, $R_2$, or $R_3$ is a nitro group, a hydroxyl group, a cyano group, a sulfo group, an alkoxy group, an aryloxy group, an acyloxy group, an acylamino group, a sulfonamido group, a sulfamoyl group, a halogen atom, a carboxyl group, a carbamoyl group, an alkoxycarbonyl group, or a sulfonyl group.

4. A silver halide color photographic material as in claim 2, wherein the compound capable of reacting with and fixing formaldehyde vapor is a compound represented by formula (I).

5. A silver halide color photographic material as in claim 2, wherein the compound represented by formula (I) or (II) is a compound represented by one of formulae (I-1) to (I-8) and (II-1) to (II-2), including keto-enol tautomers thereof

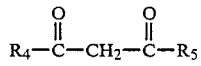

[I-1]

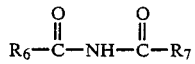

[I-2]

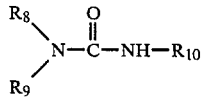

[I-3]

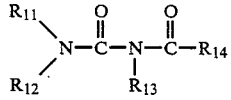

[I-4]

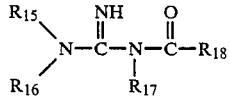

[I-5]

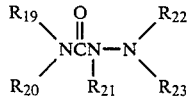

[I-6]

-continued

[I-7]

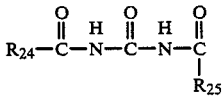

[I-8]

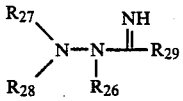

[II-1]

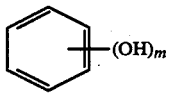

[II-2]

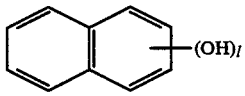

wherein $R_4$ to $R_{25}$ and $R_{27}$ to $R_{29}$, each has up to 20 carbon atoms and represents a hydrogen atom, a halogen atom, an alkyl group, a substituted alkyl group, an aralkyl group, a substituted aralkyl group, an aryl group, or a substituted aryl group and at least one of $R_{11}$, $R_{12}$, $R_{13}$, and $R_{14}$ and at least one of $R_{19}$, $R_{20}$, $R_{21}$, $R_{22}$ and $R_{23}$ represents a hydrogen atom, or $R_4$ and $R_5$, $R_6$ and $R_7$, or $R_{24}$ and $R_{25}$ together form a ring; $R_{26}$ represents a halogen atom, an alkyl group, a substituted alkyl group, an aralkyl group, a substituted aralkyl group, an aryl group, a substituted aryl group, a heterocyclic group, a carbonyl group, a sulfonyl group, a carboxyl group,

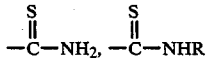

(wherein R represents an aryl group) or

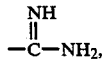

or two substituents selected from $R_8$ to $R_{10}$, $R_{11}$ to $R_{14}$, $R_{15}$ to $R_{18}$, $R_{19}$ to $R_{23}$, or $R_{26}$ to $R_{29}$ together form a ring, m represents an integer of from 3 to 6, and l represents an integer of 2 to 8.

6. A silver halide color photographic material as in claim 5, wherein a substituted alkyl group, the substituted aralkyl group or the substituted aryl group for each of $R_4$ to $R_{29}$ is a nitro group, a hydroxyl group, a cyano group, a sulfo group, an alkoxy group, an aryloxy group, an acyloxy group, an acylamino group, a sulfonamido group, a sulfamoyl group, a halogen atom, a carboxyl group, a carbamoyl group, an alkoxycarbonyl group or a sulfonyl group.

7. A silver halide color photographic material as in claim 5, wherein said compound is the compound represented by formula (I-3), (I-4), (I-5), (I-6), (I-7), or (I-8).

8. A silver halide color photographic material as in claim 7, wherein said compound is the compound represented by formula (I-3a)

(I-3a)

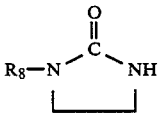

wherein $R_8$ has the same meaning as defined above.

9. A silver halide color photographic material as in claim 7, wherein said compound is the compound represented by formula (I-3b)

(I-3b)

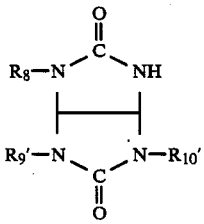

wherein $R_8$ has the same meaning as defined above, and $R_9'$ and $R_{10}'$ have the same meanings as defined for $R_9$ and $R_{10}$, respectively, as defined above.

10. A silver halide color photographic material as in claim 7, wherein said compound is at least one compound represented by formula (I-3a)

(I-3a)

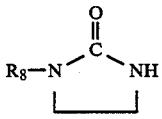

wherein $R_8$ has the same meaning as defined above, and at least one compound represented by formula (I-3b)

(I-3b)

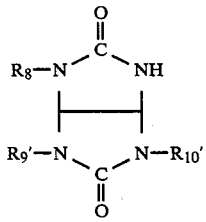

wherein $R_8$ has the same meaning as defined above, and $R_9'$ and $R_{10}'$ have the same meanings as defined for $R_9$ and $R_{10}$, respectively, as defined above.

11. A silver halide color photographic material as in claim 1, wherein the compound capable of reacting with and fixing formaldehyde vapor is present in a silver halide emulsion layer, a subbing layer, a protective layer, an intermediate layer, a filter layer, or an antihalation layer.

12. A silver halide color photographic material as in claim 11, wherein the compound capable of reacting with and fixing formaldehyde vapor is present in a layer which is positioned further away from the support than a silver halide emulsion layer containing an uncolored 5-pyrazolone 2-equivalent magenta coupler.

13. A silver halide color photographic material as in claim 11, wherein the compound capable of reacting with and fixing formaldehyde vapor is present in a protective layer.

14. A silver halide color photographic material as in claim 1, wherein the compound capable of reacting with and fixing formaldehyde vapor is present in a range of from 0.005 g to 5 g per square meter of the photographic light-sensitive material.

15. A silver halide color photographic material as in claim 1, wherein the compound capable of reacting with and fixing formaldehyde vapor is present in a range of from 0.01 g 1 g per square meter of the photographic light-sensitive material.

16. A silver halide color photographic material as in claim 15, wherein the compound capable of reacting with and fixing formaldehyde vapor is present in a range of from 0.05 g to 0.5 g per square meter of the photographic light-sensitive material.

17. A silver halide color photographic material as in claim 1, wherein the uncolored 5-pyrazolone 2-equivalent magenta coupler is represented by formula (A)

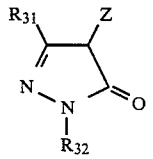

(A)

wherein $R_{31}$ represents a carboxamido group, an anilino group, a sulfonamido group, or a ureido group; $R_{32}$ represents a phenyl group; and Z represents a group capable of being released as an anion upon the coupling reaction with an oxidation product of an aromatic primary amine developing agent.

18. A silver halide color photographic material as in claim 17, wherein the group capable of being released represented by Z has 1 to 32 carbon atoms and is a group containing an aliphatic group, an aromatic group, a heterocyclic group, an aliphatic, aromatic, or heterocyclic sulfonyl group, an aliphatic, aromatic or heterocyclic carbonyl group, a carbamoyl group, an alkoxycarbonyl group, or an aryloxycarbonyl group with the coupling active carbon atom through an oxygen atom, a nitrogen atom, a sulfur atom, or a carbon atom, a halogen atom, an aromatic azo group or a heterocyclic group.

19. A silver halide color photographic material as in claim 17, wherein a substituent for the aliphatic group, aromatic group, or heterocyclic group included in the group represented by Z and for the groups represented by $R_{31}$ and $R_{32}$ is a halogen atom, an alkyl group, an alkenyl group, an aryl group, an alkoxy group, an aryloxy group, an acyl group, a sulfonyl group, a carboxyl group, a sulfo group, a cyano group, a hydroxyl group, an amino group, a carbonamido group, a sulfonamido group, an acyloxy group, a sulfonyloxy group, an alkoxycarbonyl group, an aryloxycarbonyl group, a carbamoyl group, a sulfamoyl group, an imido group, a heterocyclic group, an alkylthio group or an arylthio group.

20. A silver halide color photographic material as in claim 17, wherein the group capable of being released represented by Z is a halogen atom, an alkoxy group, an aryloxy group, an acyloxy group, an aliphatic or aromatic sulfonyloxy group, a carboxamido group, an aliphatic or aromatic sulfonamido group, an alkoxycarbonyloxy group, an aryloxycarbonyloxy group, an aliphatic, aromatic or heterocyclic thio group, a ureido group, a 5-membered or 6-membered nitrogen-containing heterocyclic group, or an imido group.

21. A silver halide color photographic material as in claim 20, wherein the group capable of being released represented by Z is a 5- or 6-membered nitrogen atom-containing heterocyclic group wherein the nitrogen atom is attached to the 4-position of the 5-pyrazolone nucleus.

22. A silver halide color photographic material as in claim 20, wherein the group capable of being released represented by Z is a 1-pyrazolyl group.

23. A silver halide color photographic material as in claim 17, wherein the uncolored 5-pyrazolone 2-equivalent magenta coupler is a bis coupler wherein any of $R_{31}$, $R_{32}$, and Z is a divalent group.

24. A silver halide color photographic material as in claim 17, wherein wherein the uncolored 5-pyrazolone 2-equivalent magenta coupler is a polymer which is derived from a monomer coupler represented by the formula ($C_p-1$)

$$CH_2{=}\overset{\overset{\displaystyle R}{|}}{C}\text{-}(A_2)_i\text{-}(A_3)_j\text{-}(A_1)_k\text{-}Q \qquad (C_p\text{-}1)$$

wherein R represents a hydrogen atom, a lower alkyl group containing from 1 to 4 carbon atoms or a chlorine atom; $A_1$ represents —CONR'—, —NR'CONR'—, —NR'COO—, —COO—, —$SO_2$—, —CO—, —NR'CO—, —$SO_2$NR'—, —NR'$SO_2$—, —OCO—, —OCONR'—, —NR'— or —O—; $A_2$ represents —CONR'— or —COO—; R' has up to 20 carbon atoms and represents a hydrogen atom, an aliphatic group, or an aryl group, and when two or more R groups are present in one molecule, they may be the same or different; $A_3$ represents an unsubstituted or substituted alkylene group having from 1 to 10 carbon atoms which may be a straight chain or a branched chain, an unsubstituted or substituted aralkylene group or an unsubstituted or substituted arylene group; Q represents a residue of the magenta coupler represented by formula (A) which may be bonded at any portion of $R_{31}$, $R_{32}$, and Z; and i, j, and k each represents 0 or 1;

or a mixture of the monomer coupler represented by formula ($C_p-1$) and at least one kind of a non-color forming monomer containing at least one ethylene group which does not have an ability of coupling with the oxidation product of an aromatic primary amine developing agent.

25. A silver halide color photographic material as in claim 24, wherein the substituent for the alkylene group, the aralkylene group or the arylene group represented by $A_3$ is an aryl group, a nitro group, a hydroxyl group, a cyano group, a sulfo group, an alkoxy group, an aryloxy group, an acyloxy group, a sulfo group, an alkoxy group, an aryloxy group, an acyloxy group, an acylamino group, a sulfonamido group, a sulfamoyl group, a halogen atom, a carboxyl group, a carbamoyl group, an alkoxycarbonyl group, or a sulfonyl group.

26. A silver halide color photographic material as in claim 24, wherein the non-color forming monomer is an acrylic acid, an α-alkylacrylic acid, an acrylic acid ester, an acrylic acid amide, a vinyl ester, an acrylonitrile, an aromatic vinyl compound, a maleic acid derivative, or a vinylpyridine.

27. A silver halide color photographic material as in claim 26, wherein the non-color forming monomer is a mixture of an aromatic vinyl compound and one monomer selected from the group consisting of an acrylic acid, an α-alkylacrylic acid, an acrylic acid ester, an acrylic acid amide, a vinyl ester, an acrylonitrile, a maleic acid derivative and a vinylpyridine.

28. A silver halide color photographic material as in claim 1, wherein the uncolored 5-pyrazolone 2-equivalent magenta coupler is present in a silver halide emulsion layer.

29. A silver halide color photographic material as in claim 28, wherein the silver halide emulsion layer is a green-sensitive silver halide emulsion layer.

30. A silver halide color photographic material comprising a support having thereon at least one silver halide emulsion layer, wherein the silver halide color photographic material contains an uncolored magenta coupler and at least one compound capable of reacting with and fixing formaldehyde vapor, and at least 70 mol % based on the total amount of the uncolored magenta coupler present in the silver halide color photographic light-sensitive material is an uncolored 5-pyrazolone 2-equivalent magenta coupler, wherein the silver halide color photographic material further contains at least one compound represented by formula (III) or formula (IV)

(III)

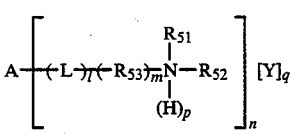

(IV)

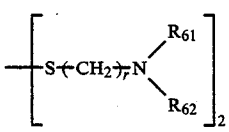

wherein A represents an n-valent aliphatic, aromatic or heterocyclic linking group (when n is 1, A simply represents an aliphatic, aromatic or heterocyclic group or a hydrogen atom); L represents —O—, —S— or $$-\overset{R_{54}}{\overset{|}{N}}-;$$

$R_{51}$ and $R_{52}$ each represents a substituted or unsubstituted lower alkyl group; $R_{53}$ represents a substituted or unsubstituted lower alkylene group; $R_{54}$ represents a substituted or unsubstituted lower alkyl group; or $R_{51}$ and $R_{52}$, $R_{51}$ and A, $R_{51}$ and $R_{53}$, $R_{52}$ and A, or $R_{52}$ and $R_{53}$ together form a ring; Y represents an anion; l represents 0 or 1; m represents 0 or 1; n represents 1, 2, or 3; p represents 0 or 1; and q represents 0, 1, 2 or 3, and wherein $R_{61}$ and $R_{62}$ each represents a hydrogen atom, a lower alkyl group or an acyl group, provided that they do not simultaneously represent a hydrogen atom; or $R_{61}$ and $R_{62}$ together form a ring; and r represents 1, 2, or 3.

31. A silver halide color photographic material as in claim 30, wherein the silver halide color photographic material further contains at least one compound represented by formula (III) or formula (IV)

(III)

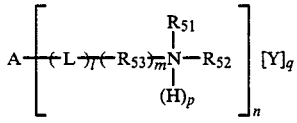

(IV)

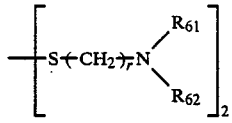

wherein A represents an alkylene group having 3 to 12 carbon atoms, an arylene group having 6 to 18 carbon atoms or a 5- or 6-membered heterocyclic group having at least one hetero atom selected from the group consisting of an oxygen atom, a sulfur atom and a nitrogen atom; L represents —O—, —S— or $$-\overset{R_{54}}{\overset{|}{N}}-;$$

$R_{51}$ and $R_{52}$ each represents a substituted or unsubstituted lower alkyl group having 1 to 5 carbon atoms; $R_{53}$ represents a substituted or unsubstituted lower alkylene group having 1 to 5 carbon atoms; $R_{54}$ represents a substituted or unsubstituted lower alkyl group having 1 to 5 carbon atoms; or $R_{51}$ and $R_{52}$, $R_{51}$ and A, $R_{51}$ and $R_{53}$, $R_{52}$ and A, or $R_{52}$ and $R_{53}$ together form a 5- or 6-membered heterocyclic ring; Y represents an anion; l represents 0 or 1; m represents 0 or 1; n represents 1, 2, or 3; p represents 0 or 1; and q represents 0, 1, 2 or 3, and wherein $R_{61}$ and $R_{62}$ each represents a hydrogen atom, a lower alkyl group having 1 to 5 carbon atoms or an acyl group having 1 to 3 carbon atoms, provided that they do not simultaneously represent a hydrogen atom; or $R_{61}$ and $R_{62}$ together form a 5-, 6- or 7-membered nitrogen atom containing heterocyclic ring; and r represents 1, 2, or 3.

32. A silver halide color photographic material as in claim 31, wherein the linking group represented by A is a group composed of two or more member selected from the group consisting of an arylene group having 6 to 18 carbon atoms or a 5- or 6-membered heterocyclic group having at least one hetero atom selected from the group consisting of an oxygen atom, a sulfur atom and a nitrogen atom, said two or more members being connected either directly or via one or more divalent groups selected from the group consisting of —O—, —S—, $$-\overset{R_{55}}{\overset{|}{N}}-,$$

$-SO_2-$, —CO— and combinations thereof.

33. A silver halide color photographic material as in claim 31, wherein the linking group represented by A has a substituent selected from the group consisting of an alkoxy group, a halogen atom, an alkyl group, a hydroxyl group, a carboxyl group, a sulfo group, a sulfonamido group, and a sulfamoyl group.

34. A silver halide color photographic material as in claim 31, wherein the lower alkyl group represented by $R_{51}$ or $R_{52}$ has a substituent selected from the group consisting of a hydroxyl group, a lower alkoxy group and an amino group.

35. A silver halide color photographic material as in claim 31, wherein the anion represented by Y is a halide ion, a nitrate ion, a sulfate ion, a p-toluenesulfonate ion or an oxalate ion.

36. A silver halide color photographic material as in claim 31, wherein the substituent for the lower alkyl group or the acyl group represented by $R_{61}$ or $R_{62}$ is a hydroxyl group, a carboxyl group, a sulfo group, an amino group.

37. A silver halide color photographic material as in claim 30, wherein the total amount of the compound represented by formula (III) and/or the compound represented by formula (IV) is from $1\times10^{-5}$ to $1\times10^{-2}$ mol/m$^2$.

38. A silver halide color photographic material as in claim 30, wherein the total amount of the compound represented by formula (III) and/or the compound represented by formula (IV) is from $2\times10^{-5}$ to $5\times10^{-3}$ mol/m$^2$.

39. A silver halide color photographic material as in claim 30, wherein the total amount of the compound represented by formula (III) and/or the compound represented by formula (IV) is from $5\times10^{-5}$ to $2\times10^{-3}$ mol/m$^2$.

40. A method for processing a silver halide color photographic material comprising a support having thereon at least one silver halide emulsion layer, wherein the silver halide color photographic material contains an uncolored magenta coupler and at least one compound capable of reacting with and fixing formaldehyde vapor, and at least 70 mol % based on the total amount of the uncolored magenta coupler present in the silver halide color photographic material is an uncolored 5-pyrazolone 2-equivalent magenta coupler, wherein said method comprises washing the material with water or treating with stabilizing solution immediately after a fixing or bleach-fixing step, further wherein said washing or stabilization is carried out in a multiple concurrent system using a plurality of tanks in which a processing solution is replenished in an amount of from 3 to 50 times the amount of the processing solution carried over from the preceding bath per unit area of the photographic material.

41. The method of claim 40, wherein the compound capable of reacting with and fixing formaldehyde vapor is represented by formula (I) or (II)

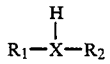
(I)

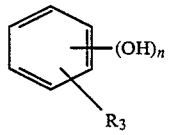
(II)

wherein $R_1$ and $R_2$ each has up to 20 carbon atoms and represents a hydrogen atom, an alkyl group, a substituted alkyl group, an aralkyl group, a substituted aralkyl group, an aryl group, a substituted aryl group, an acyl group, an alkoxycarbonyl group, a carbamoyl group, an amino group or a halogen atom, or $R_1$ and $R_2$ are bonded each other to form a ring and at least one of $R_1$ and $R_2$ is an acyl group, an alkoxycarbonyl group, a carbamoyl group or an amino group; and X represents

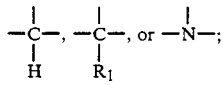

$R_3$ has up to 32 carbon atoms and represents an alkyl group, a substituted alkyl group, an aralkyl group, a substituted aralkyl group, an aryl group or a substituted aryl group, these aryl group and substituted aryl group may form a condensed ring together with a 5-membered, 6-membered or 7-membered ring; and n represents an integer of 2 to 8, and has an equivalent molecular weight of not more than 300 per unit of active hydrogen atom as defined by the equation below $$\text{Equivalent Molecular Weight} = \frac{\text{Molecular Weight}}{\text{Number of Active Hydrogen Atoms in Molecule}}.$$

42. The method of claim 41, wherein the compound represented by formula (I) or (II) is a compound represented by one of formulae (I-1) to (I-8) and (II-1) to (II-2), including keto-enol tautomers thereof

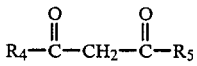
[I-1]

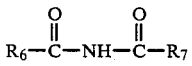
[I-2]

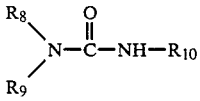
[I-3]

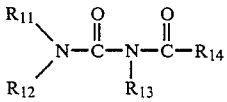
[I-4]

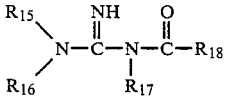
[I-5]

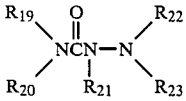
[I-6]

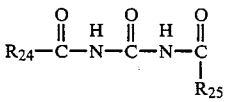
[I-7]

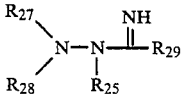
[I-8]

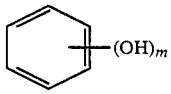
[II-1]

-continued

[II-2]

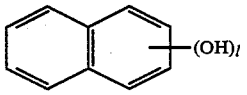

wherein $R_4$ to $R_{25}$ and $R_{27}$ to $R_{29}$, each has up to 20 carbon atoms and represents a hydrogen atom, a halogen atom, an alkyl group, a substituted alkyl group, an aralkyl group, a substituted aralkyl group, an aryl group, or a substituted aryl group and at least one of $R_{11}$, $R_{12}$, $R_{13}$, and $R_{14}$ and at least one of $R_{19}$, $R_{20}$, $R_{21}$, $R_{22}$ and $R_{23}$ represents a hydrogen atom, or $R_4$ and $R_5$, $R_6$ and $R_7$, or $R_{24}$ and $R_{25}$ together form a ring; $R_{26}$ represents a halogen atom, an alkyl group, a substituted alkyl group, an aralkyl group, a substituted aralkyl group, an aryl group, a substituted aryl group, a heterocyclic group, a carbonyl group, a sulfonyl group, a carboxyl group,

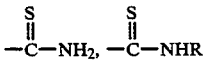

(wherein R represents an aryl group) or

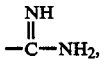

or two substituents selected from $R_8$ to $R_{10}$, $R_{11}$ to $R_{14}$, $R_{15}$ to $R_{18}$, $R_{19}$ to $R_{23}$, or $R_{26}$ to $R_{29}$ together form a ring, m represents an integer of from 3 to 6, and l represents an integer of 2 to 8.

43. The method of claim 42, wherein said compound is the compound represented by formula (I-3), (I-4), (I-5), (I-6), (I-7) or (I-8).

44. The method of claim 43, wherein said compound is the compound represented by formula (I-3a)

(I-3a)

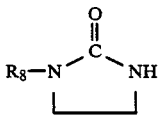

wherein $R_8$ has the same meaning as defined above.

45. The method of claim 43, wherein said compound is the compound represented by formula (I-3b)

(I-3b)

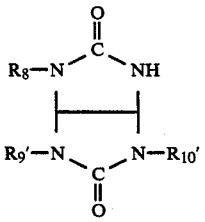

wherein $R_8$ has the same meaning as defined above, and $R_9'$ and $R_{10}'$ have the same meaning as defined for $R_9$ 10, respectively, as defined above.

46. The method of claim 43, wherein said compound is at least one compound represented by formula (I-3a)

(I-3a)

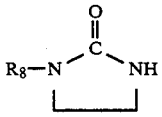

wherein $R_8$ has the same meaning as defined above, and at least one compound represented by formula (I-3b)

(I-3b)

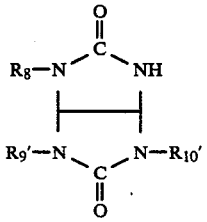

wherein $R_8$ has the same meaning as defined above, and $R_9'$ and $R_{10}'$ have the same meanings as defined for $R_9$ and $R_{10}$, respectively, as defined above.

47. The method of claim 40, wherein the compound capable of reacting with and fixing formaldehyde vapor is present in a silver halide emulsion layer, a subbing layer, a protective layer, an intermediate layer, a filter layer, or an antihalation layer.

48. The method of claim 47, wherein the compound capable of reacting with and fixing formaldehyde vapor is present in a layer which is positioned further away from the support than a silver halide emulsion layer containing an uncolored 5-pyrazolone 2-equivalent magenta coupler.

49. The method of claim 40, wherein the uncolored 5-pyrazolone 2-equivalent magenta coupler is represented by formula (A)

(A)

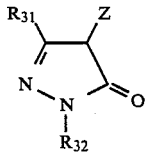

wherein $R_{31}$ represents a carboxamido group, an anilino group, a sulfonamido group, or a ureido group; $R_{32}$ represents a phenyl group; and Z represents a group capable of being released as an anion upon the coupling reaction with an oxidation product of an aromatic primary amine developing agent.

50. The method of claim 49, wherein the incolored 5-pyrazolone 2-equivalent magenta coupler is a polymer which is derived from a monomer coupler represented by the formula ($C_p-1$)

($C_p$-1)

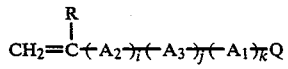

wherein R represents a hydrogen atom, a lower alkyl group containing from 1 to 4 carbon atoms or a chlorine atom; $A_1$ represents —CONR'—, —NR'CONR'—, —NR'COO—, —COO—, —$SO_2$—, —CO—, —NR'CO—, —$SO_2$NR'—, NR'$SO_2$—, —OCO—, —OCONR'—, —NR'— or —O—; $A_2$ represents —CONR'— or —COO—; R' has up to 20 carbon atoms and represents a hydrogen atom, an aliphatic group, or an aryl group, and when two or more R groups are present in one molecule, they may be the same or different; $A_3$ represents an unsubstituted or substituted alkylene group having from 1 to 10 carbon atoms which may be a straight chain or a branched chain, an unsubstituted or substituted aralkylene group or an unsubstituted or substituted arylene group; Q represents a residue of the magenta coupler represented by formula (A) which may be bonded at any portion of $R_{31}$, $R_{32}$, and Z; and i, j, and k each represents 0 or 1;

or a mixture of the monomer coupler represented by formula ($C_p-1$) and at least one kind of a non-color forming monomer containing at least one ethylene group which does not have an ability of coupling with the oxidation product of an aromatic primary amine developing agent.

* * * * *